US011289021B2

(12) United States Patent
Li et al.

(10) Patent No.: US 11,289,021 B2
(45) Date of Patent: Mar. 29, 2022

(54) PIXEL CIRCUIT, DISPLAY PANEL, DISPLAY DEVICE, AND DRIVING METHOD

(71) Applicants: BOE TECHNOLOGY GROUP CO., LTD., Beijing (CN); ORDOS YUANSHENG OPTOELECTRONICS CO., LTD., Inner Mongolia (CN)

(72) Inventors: Zihua Li, Beijing (CN); Qi Liu, Beijing (CN); Guoping Zhang, Beijing (CN); Jing Liu, Beijing (CN); Yuqing Yang, Beijing (CN); Xiping Li, Beijing (CN)

(73) Assignees: BOE TECHNOLOGY GROUP CO., LTD., Beijing (CN); ORDOS YUANSHENG OPTOELECTRONICS CO., LTD., Inner Mongolia (CN)

( * ) Notice: Subject to any disclaimer, the term of this patent is extended or adjusted under 35 U.S.C. 154(b) by 931 days.

(21) Appl. No.: 16/069,414

(22) PCT Filed: Nov. 15, 2017

(86) PCT No.: PCT/CN2017/110995
§ 371 (c)(1),
(2) Date: Jul. 11, 2018

(87) PCT Pub. No.: WO2018/145499
PCT Pub. Date: Aug. 6, 2018

(65) Prior Publication Data

US 2021/0210016 A1 Jul. 8, 2021

(30) Foreign Application Priority Data

Feb. 9, 2017 (CN) ..... 201710071641.X

(51) Int. Cl.
*G09G 3/3258* (2016.01)
*G09G 3/3291* (2016.01)
*G09G 3/3266* (2016.01)

(52) U.S. Cl.
CPC ..... *G09G 3/3258* (2013.01); *G09G 3/3266* (2013.01); *G09G 3/3291* (2013.01); (Continued)

(58) Field of Classification Search
CPC .. G09G 3/3233; G09G 3/3258; G09G 3/3291; G09G 3/3225; G09G 3/3275; (Continued)

(56) References Cited

U.S. PATENT DOCUMENTS

2003/0210212 A1 11/2003 Li et al.
2006/0176250 A1 8/2006 Nathan et al.
(Continued)

FOREIGN PATENT DOCUMENTS

CN 101051441 A 10/2007
CN 101116128 A 1/2008
(Continued)

OTHER PUBLICATIONS

International Search Report and Written Opinion dated Feb. 14, 2018; PCT/CN2017/110995.
(Continued)

*Primary Examiner* — Dong Hui Liang

(57) ABSTRACT

A pixel circuit, a display panel, a display device and a driving method are provided. The pixel circuit provides an initial signal having an excitation pulse to a control electrode of a driving transistor through a reset circuit in advance; and the initial signal having a preset voltage is provided to the control electrode of the driving transistor after a preset duration.

18 Claims, 14 Drawing Sheets

(52) U.S. Cl.
CPC ..... *G09G 2300/043* (2013.01); *G09G 2300/0426* (2013.01); *G09G 2310/061* (2013.01)

(58) Field of Classification Search
CPC ..... G09G 3/3208; G09G 2300/0861; G09G 2300/0819; G09G 2300/0842; G09G 2300/0852; G09G 2300/0426; G09G 2300/043; G09G 2300/0452; G09G 2310/0262; G09G 2310/0251; G09G 2310/061; G09G 2310/0245; G09G 2320/045; G09G 2320/0257; G09G 2320/0233; G09G 2320/043
See application file for complete search history.

(56) References Cited

U.S. PATENT DOCUMENTS

2008/0094320 A1* 4/2008 Parikh ..... G09G 3/3266 345/76
2015/0090970 A1* 4/2015 Park ..... H01L 27/322 257/40
2016/0372049 A1* 12/2016 Wang ..... G09G 3/3233
2017/0039955 A1* 2/2017 Park ..... G09G 3/3233
2017/0061875 A1* 3/2017 Cho ..... G09G 3/3233
2017/0269783 A1 9/2017 Yang et al.

FOREIGN PATENT DOCUMENTS

CN 104157240 A 11/2014
CN 105139804 A 12/2015
CN 106652915 A 5/2017

OTHER PUBLICATIONS

The First Chinese Office Action dated May 3, 2018; Appln. No. 2017100071641.X.

* cited by examiner

PIXEL CIRCUIT, DISPLAY PANEL, DISPLAY DEVICE, AND DRIVING METHOD

TECHNICAL FIELD

Embodiments of the present disclosure relate to a pixel circuit, a display panel, a display device and a driving method.

BACKGROUND

Organic light emitting diode (OLED) displays involve one of the hotspots in the research field of flat panel displays nowadays. Compared with liquid crystal displays (LCDs), OLED displays have the advantages such as low energy consumption, low production cost, self-luminescence, wide viewing angle, fast response speed, and so on. At present, OLED displays have begun to replace traditional LCDs in display areas such as mobile phone, tablet computer, digital camera and so on.

Unlike LCDs, which use a stable voltage to control brightness, OLEDs are driven by electric current and need stable electric current to control themselves to emit light. Generally, an OLED display outputs an electric current to the OLED through a driving transistor in a pixel circuit in each sub-pixel unit to drive the OLED to emit light. However, the time period during which the driving transistor drives a light emitting device to emit light is generally long, resulting in the gate electrode of the driving transistor being under an effect of a certain voltage for a long time, so that a hysteresis phenomenon occurs in the driving transistor. Due to the hysteresis phenomenon of the driving transistor, when the display displays the next image, the voltage of the gate electrode of the driving transistor fails to reach a predetermined voltage in time, thereby causing a problem that an afterimage occurs in the display image.

SUMMARY

At least one embodiment of the present disclosure provides a pixel circuit, comprising: a reset circuit, a data writing circuit, a driving transistor and a light emitting device. The driving transistor comprises a control electrode, a first electrode and a second electrode, the light emitting device comprises a first terminal and a second terminal, the first electrode of the driving transistor is configured to be connected to a first power supply terminal, the second electrode of the driving transistor is configured to be connected to the second terminal of the light emitting device, and the first terminal of the light emitting device is configured to be connected to a second power supply terminal; the reset circuit is connected to the control electrode of the driving transistor, and is configured to provide an initial signal having an excitation pulse to the control electrode of the driving transistor under control of a reset signal, and provide the initial signal having a preset voltage to the control electrode of the driving transistor after a preset duration, and there is a voltage difference between a voltage of the excitation pulse and the preset voltage; and the data writing circuit is configured to provide a data signal to the driving transistor under control of a scanning signal.

For example, the pixel circuit provided by at least one embodiment of the present disclosure further comprises: a voltage input circuit, a compensation control circuit, a voltage storage circuit, a light emission control circuit and a first node. The voltage input circuit is connected to the first node and the first power supply terminal, and is configured to provide a voltage signal of the first power supply terminal to the first node under control of the reset signal; the data writing circuit is connected to the first node, and is configured to provide the data signal to the first node under control of the scanning signal; the compensation control circuit is connected to the control electrode of the driving transistor and the second electrode of the driving transistor, and is configured to electrically conduct the control electrode of the driving transistor and the second electrode of the driving transistor under control of the scanning signal; the voltage storage circuit is connected to the control electrode of the driving transistor and the first node, and is configured to charge or discharge under control of a signal of the first node and a signal of the control electrode of the driving transistor, and keep a voltage difference between the first node and the control electrode of the driving transistor stable when the control electrode of the driving transistor is in a floating state; and the light emission control circuit is configured to provide a reference signal to the first node and provide a signal of the second electrode of the driving transistor to the second terminal of the light emitting device under control of a light emission control signal.

For example, in the pixel circuit provided by at least one embodiment of the present disclosure, the driving transistor is a P-type transistor, and the excitation pulse is an excitation pulse having a negative voltage; or the driving transistor is an N-type transistor, and the excitation pulse is an excitation pulse having a positive voltage.

For example, in the pixel circuit provided by at least one embodiment of the present disclosure, the excitation pulse comprises an excitation sub-pulse having a negative voltage and an excitation sub-pulse having a positive voltage; the driving transistor is a P-type transistor, and the excitation pulse first is the excitation sub-pulse having the negative voltage, and then is the excitation sub-pulse having the positive voltage; or the driving transistor is an N-type transistor, and the excitation pulse first is the excitation sub-pulse having the positive voltage, and then is the excitation sub-pulse having the negative voltage.

For example, in the pixel circuit provided by at least one embodiment of the present disclosure, the reset circuit comprises: a first switching transistor; and a control electrode of the first switching transistor is configured to receive the reset signal, a first electrode of the first switching transistor is configured to receive the initial signal, and a second electrode of the first switching transistor is connected to the control electrode of the driving transistor.

For example, in the pixel circuit provided by at least one embodiment of the present disclosure, the voltage input circuit comprises: a second switching transistor; and a control electrode of the second switching transistor is configured to receive the reset signal, a first electrode of the second switching transistor is connected to the first power supply terminal, and a second electrode of the second switching transistor is connected to the first node.

For example, in the pixel circuit provided by at least one embodiment of the present disclosure, the data writing circuit comprises: a third switching transistor; and a control electrode of the third switching transistor is configured to receive the scanning signal, and a first electrode of the third switching transistor is configured to receive the data signal.

For example, in the pixel circuit provided by at least one embodiment of the present disclosure, the compensation control circuit comprises: a fourth switching transistor; and a control electrode of the fourth switching transistor is configured to receive the scanning signal, a first electrode of the fourth switching transistor is connected to the control electrode of the driving transistor, and a second electrode of the fourth switching transistor is connected to the second electrode of the driving transistor.

For example, in the pixel circuit provided by at least one embodiment of the present disclosure, the light emission control circuit comprises: a fifth switching transistor and a sixth switching transistor; wherein a control electrode of the fifth switching transistor is configured to receive the light emission control signal, a first electrode of the fifth switching transistor is configured to receive the reference signal, and a second electrode of the fifth switching transistor is connected to the first node; and a control electrode of the sixth switching transistor is configured to receive the light emission control signal, a first electrode of the sixth switching transistor is connected to the second electrode of the driving transistor, and a second electrode of the sixth switching transistor is connected to the second terminal of the light emitting device.

For example, in the pixel circuit provided by at least one embodiment of the present disclosure, the voltage storage circuit comprises at least one capacitor; and a first terminal of the capacitor is connected to the first node, and a second terminal of the capacitor is connected to the control electrode of the driving transistor.

At least one embodiment of the present disclosure provides a display panel, comprising a plurality of sub-pixel units, each of the sub-pixel units comprising any one of the pixel circuits described above.

For example, the display panel provided by at least one embodiment of the present disclosure further comprises a display driver; and the display driver is configured to provide the initial signal having the excitation pulse to the control electrode of the driving transistor, and provide the initial signal having the preset voltage to the control electrode of the driving transistor after the preset duration, and there is a voltage difference between the voltage of the excitation pulse and the preset voltage.

For example, the display panel provided by at least one embodiment of the present disclosure further comprises a display driver; and the display driver is configured to determine the preset voltage of the initial signal according to a type of the driving transistor in the pixel circuit, and determine the excitation pulse of the initial signal according to the determined preset voltage and a duration of scanning a row of sub-pixel units in the display panel; when the pixel circuit is in an excitation phase, the excitation pulse is input to an initial signal terminal; and when the pixel circuit is in a reset phase, the preset voltage is input to the initial signal terminal.

For example, in the display panel provided by at least one embodiment of the present disclosure, the display driver inputs the initial signal to the pixel circuits of the sub-pixel units in a same row through a same signal line; and the display driver is further configured to determine a period duration of the initial signal according to a duration of scanning a row of sub-pixel units in the display panel.

At least one embodiment of the present disclosure provides a display device, comprising any one of the display panels described above.

At least one embodiment of the present disclosure provides a driving method of any one of the pixel circuits described above, comprising: providing the initial signal having the excitation pulse to the control electrode of the driving transistor, and providing the initial signal having the preset voltage to the control electrode of the driving transistor after the preset duration, there being a voltage difference between the voltage of the excitation pulse and the preset voltage.

At least one embodiment of the present disclosure provides a driving method of at least one pixel circuit described above, comprising: an excitation phase, a reset phase, a compensation phase and a light emitting phase. In the excitation phase, the reset circuit provides the initial signal having the excitation pulse to the control electrode of the driving transistor under control of the reset signal; the voltage input circuit provides the voltage signal of the first power supply terminal to the first node under control of the reset signal; and the voltage storage circuit discharges under control of the signal of the first node and the signal of the control electrode of the driving transistor. In the reset phase, the reset circuit provides the initial signal having the preset voltage to the control electrode of the driving transistor under control of the reset signal; the voltage input circuit provides the voltage signal of the first power supply terminal to the first node under control of the reset signal; and the voltage storage circuit discharges under control of the signal of the first node and the signal of the control electrode of the driving transistor. In the compensation phase, the data writing circuit provides the data signal to the first node under control of the scanning signal; the compensation control circuit electrically conducts the control electrode of the driving transistor and the second electrode of the driving transistor under control of the scanning signal, controlling the driving transistor to be in a diode state; and the voltage storage circuit charges under control of the signal of the first node and the signal of the control electrode of the driving transistor. In the light emitting phase, the voltage storage circuit keeps the voltage difference between the first node and the control electrode of the driving transistor stable when the control electrode of the driving transistor is in the floating state; and the light emission control circuit provides the reference signal to the first node and provides the signal of the second electrode of the driving transistor to the second terminal of the light emitting device under control of the light emission control signal, so as to control the driving transistor to drive the light emitting device to emit light.

At least one embodiment of the present disclosure provides a driving method of at least one display panel described above, comprising: determining the preset voltage of the initial signal according to a type of the driving transistor in the pixel circuit, and determining the excitation pulse of the initial signal according to the determined preset voltage and a duration of scanning a row of the pixel circuits in the display panel; when the pixel circuit is determined to be in an excitation phase, inputting the excitation pulse to an initial signal terminal; and when the pixel circuit is determined to be in a reset phase, inputting the preset voltage to the initial signal terminal.

BRIEF DESCRIPTION OF THE DRAWINGS

In order to clearly illustrate the technical solution of the embodiments of the disclosure, the drawings of the embodiments will be briefly described in the following. It is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", "coupled", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

An embodiment of the present disclosure provides a pixel circuit, for example, which can be used for a pixel of an OLED display panel.

Figure 1A:
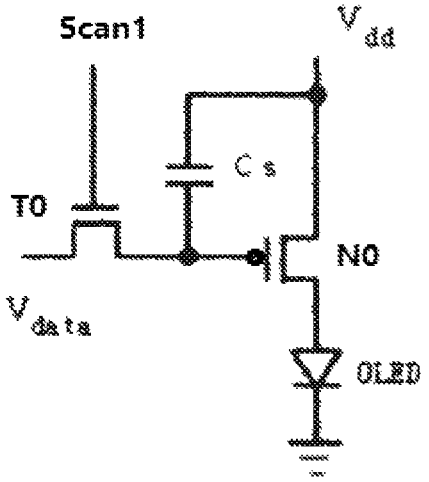
FIG. 1A is a schematic diagram of a 2T1C pixel circuit.
Figure 1B:
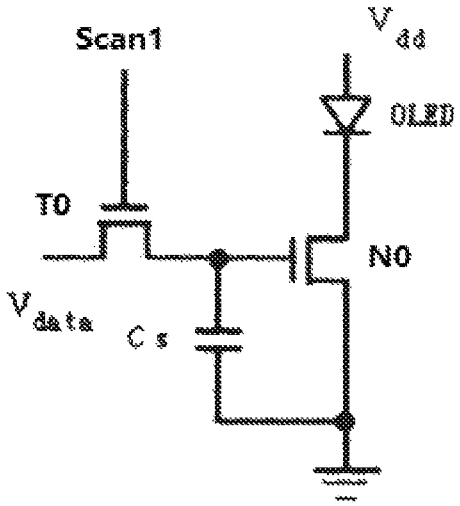
FIG. 1B is a schematic diagram of another 2T1C pixel circuit.

A pixel circuit used for an AMOLED display panel is generally a 2T1C pixel circuit, i.e., two thin film transistors (TFTs) and one storage capacitor Cs are used to realize the basic function of driving an OLED to emit light. FIG. 1A and FIG. 1B are schematic diagrams respectively illustrating two types of 2T1C pixel circuits.

As illustrated in FIG. 1A, a 2T1C pixel circuit comprises a switching transistor T0, a driving transistor N0 and a storage capacitor Cs. For example, a gate electrode of the switching transistor T0 is connected to a gate line (scanning line) to receive a scanning signal (Scan1), a source electrode of the switching transistor T0 is connected to a data line to receive a data signal (Vdata), and a drain electrode of the switching transistor T0 is connected to a gate electrode of the driving transistor N0. A source electrode of the driving transistor N0 is connected to a first power supply terminal (Vdd, high voltage terminal) and a drain electrode of the driving transistor N0 is connected to an anode of an OLED. One terminal of the storage capacitor Cs is connected to both the drain electrode of the switching transistor T0 and the gate electrode of the driving transistor N0, and the other terminal of the storage capacitor Cs is connected to the source electrode of the driving transistor N0 and the first power supply terminal. A cathode of the OLED is connected to a second power supply terminal (Vss, low voltage terminal), such as ground. The driving mode of the 2T1C pixel circuit is that the brightness and darkness (gray level) of the pixel is controlled by the two TFTs and the storage capacitor Cs. When the scanning signal Scan1 is applied through the gate line to turn on the switching transistor T0, the data voltage (Vdata) input by a data driving circuit through the data line charges the storage capacitor Cs through the switching transistor T0, thereby storing the data voltage in the storage capacitor Cs. The stored data voltage controls the conduction level of the driving transistor N0, thereby controlling the electric current flowing through the driving transistor to drive the OLED to emit light, that is, the electric current determines the gray level of light emitted by the pixel. In the 2T1C pixel circuit illustrated in FIG. 1A, the switching transistor T0 is an N-type transistor and the driving transistor is a P-type transistor.

As illustrated in FIG. 1B, another 2T1C pixel circuit also comprises the switching transistor T0, the driving transistor N0 and the storage capacitor Cs, but the connection mode thereof is slightly changed, and the driving transistor N0 is an N-type transistor. More specifically, the difference of the pixel circuit in FIG. 1B compared with that in FIG. 1A comprises: the anode of the OLED is connected to the first power supply terminal (Vdd, high voltage terminal), the cathode of the OLED is connected to the drain electrode of the driving transistor N0, and the source electrode of the driving transistor N0 is connected to the second power supply terminal (Vss, low voltage terminal), such as ground. One terminal of the storage capacitor Cs is connected to both the drain electrode of the switching transistor T0 and the gate electrode of the driving transistor N0, and the other terminal of the storage capacitor Cs is connected to the source electrode of the driving transistor N0 and the second power supply terminal. The operation mode of the 2T1C pixel circuit is basically the same as the pixel circuit illustrated in FIG. 1A, and will not be repeated here.

In addition, for the pixel circuits illustrated in FIG. 1A and FIG. 1B, the switching transistor T0 is not limited to an N-type transistor, but may be a P-type transistor as well, thus the polarity of the scanning signal (Scan1) which controls the switching transistor T0 to turn on or turn off is changed accordingly.

An OLED display panel generally comprises a plurality of sub-pixel units arranged in an array, and for example, each of the sub-pixel units may adopt the above pixel circuit. However, in an organic light emitting diode (OLED) display panel, there is an IR drop phenomenon caused by a voltage division of the self-resistance of a wire in the display panel, that is, when an electric current flows through the wire in the display panel, there is a certain voltage drop along the wire according to the Ohm's law. Therefore, the pixel units located at different positions are affected by the IR drop to different extents, which causes the display panel to display nonuniformly. Therefore, it is necessary to compensate for the IR drop in the OLED display panel. In addition, in OLED display panels, the threshold voltage of the driving transistor in each pixel unit may be different due to the manufacturing process, and the threshold voltage of the driving transistor may also drift due to, for example, an effect of a temperature change. Therefore, the difference between the threshold voltages of the driving transistors may also cause the display panel to display nonuniformly. Therefore, it also leads to the need to compensate for the threshold voltage.

Therefore, other pixel circuits having compensation functions based on the basic 2T1C pixel circuit are provided in the industry. The compensation function may be achieved through the way of voltage compensation, electric current compensation, or composite compensation. The pixel circuit having a compensation function may be, for example, 4T1C, 4T2C, or the like. For example, in the pixel circuit having a compensation function, a data writing circuit and a compensation circuit cooperate with each other to write a voltage value carrying information of the data voltage and the threshold voltage of the driving transistor into a control electrode of the driving transistor, which is stored by a voltage storage circuit. Examples of the specific compensation circuits will not be described in detail again here.

At least one embodiment of the present disclosure provides a pixel circuit and a driving method thereof. The pixel circuit comprises a reset circuit, a data writing circuit, a driving transistor and a light emitting device. The driving transistor comprises a control electrode, a first electrode and a second electrode, the light emitting device comprises a first terminal and a second terminal, the first electrode of the driving transistor is configured to be connected to a first power supply terminal, the second electrode of the driving transistor is configured to be connected to the second terminal of the light emitting device, and the first terminal of the light emitting device is configured to be connected to a second power supply terminal; the reset circuit is connected to the control electrode of the driving transistor, and is configured to provide an initial signal having an excitation pulse to the control electrode of the driving transistor under control of a reset signal, and provide the initial signal having a preset voltage to the control electrode of the driving transistor after a preset duration, and there is a voltage difference between a voltage of the excitation pulse and the preset voltage; and the data writing circuit is configured to provide a data signal to the driving transistor under control of a scanning signal.

Figure 2A:
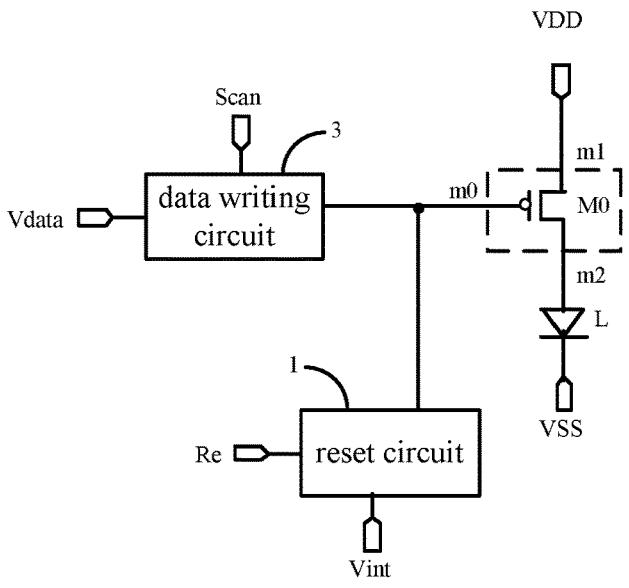
FIG. 2A is a first structural schematic diagram of a pixel circuit provided by an embodiment of the present disclosure.
Figure 2B:
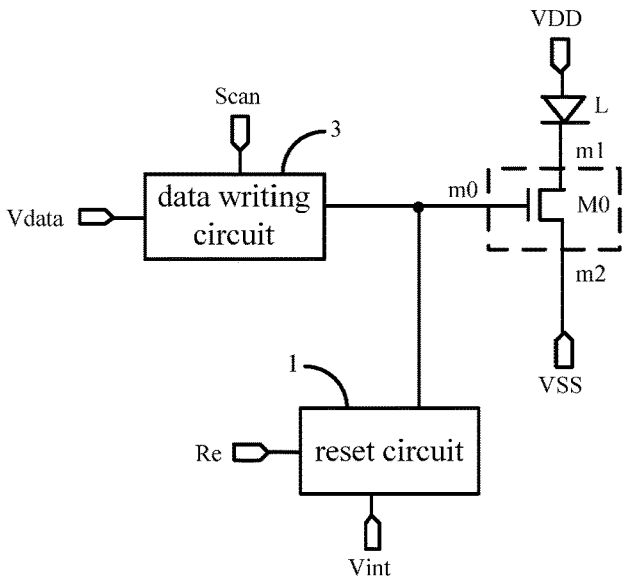
FIG. 2B is a second structural schematic diagram of a pixel circuit provided by the embodiment of the present disclosure.

As illustrated in FIGS. 2A and 2B, the pixel circuit of at least one embodiment of the present disclosure comprises a reset circuit 1, a data writing circuit 3, a driving transistor M0 and a light emitting device L. The pixel circuit, for example, may be used for the sub-pixel unit of an AMOLED display panel, and the light emitting device is an OLED in this case. In the example of FIG. 2A, the driving transistor M0 is a P-type transistor, and for example, the light emitting devices L in the pixel circuits in different sub-pixel units have a common anode. In the example of FIG. 2B, the driving transistor M0 is an N-type transistor, and for example, the light emitting devices L in the pixel circuits in different sub-pixel units have a common cathode.

In the above two examples, the driving transistor M0 comprises a control electrode m0, a first electrode m1 and a second electrode m2, the light emitting device L comprises a first terminal and a second terminal, the first electrode m1 of the driving transistor M0 is connected to a first power supply terminal, the second electrode m2 of the driving transistor is connected to the second terminal of the light emitting device L, and the first terminal of the light emitting device L is connected to a second power supply terminal. The reset circuit 1 is connected to the control electrode m0 of the driving transistor, and is configured to provide an initial signal Vint having an excitation pulse to the control electrode m0 of the driving transistor under control of a reset signal Re, and provide the initial signal having a preset voltage to the control electrode m0 of the driving transistor after a preset duration, and there is a voltage difference between a voltage of the excitation pulse and the preset voltage. The data writing circuit 3 is configured to provide a data signal Vdata to the driving transistor M0 under control of a scanning signal Scan.

In FIG. 2A, for example, a high voltage power supply terminal VDD and a low voltage power supply terminal VSS respectively serve as examples of the first power supply terminal and the second power supply terminal. In FIG. 2B, for example, the high voltage power supply terminal VDD and the low voltage power supply terminal VSS respectively serve as examples of the second power supply terminal and the first power supply terminal.

The pixel circuit in the above embodiment may further comprise a voltage storage circuit, which is used for storing a data voltage written from the data writing circuit 3. For example, the voltage storage circuit may be implemented through at least one capacitor. In the pixel circuit described above, the voltage storage circuit may adopt different connection modes. For example, referring to the cases as illustrated in FIGS. 1A and 1B, the voltage storage circuit may be connected between the control electrode of the driving transistor and a power supply terminal (for example, the power supply terminal VDD or the power supply terminal VSS), and for example, may also be connected between the data writing circuit 3 and the control electrode of the driving transistor, etc., which is not limited in the embodiment of the present disclosure.

In addition, the pixel circuit in the above embodiment may further comprise a compensation control circuit. In this case, the voltage storage circuit not only stores the data voltage in a compensation phase, but also may further store, for example, information including the threshold voltage of the driving transistor and/or the voltage of the first voltage terminal, so as to use in a light emitting phase.

For example, in at least one embodiment of the present disclosure, it only needs to apply the excitation pulse (AC signal) to the control electrode of the driving transistor in a reset phase through the reset circuit in advance, and then apply the initial voltage (DC signal), without limitation to other structures of the pixel circuit except the data writing circuit, the driving transistor, the light emitting device, and the like.

In the operation of the pixel circuit in at least one embodiment of the present disclosure, the initial signal having the excitation pulse is first provided to the control electrode of the driving transistor through the reset circuit to excite the voltage of the control electrode of the driving transistor, so that the voltage of the control electrode of the driving transistor is significantly changed, thereby rapidly eliminating the voltage information of the driving transistor of the pixel circuit remaining from the last time of light emitting (e.g., the previous frame display of the display panel). And then the initial signal having the preset voltage is provided to the control electrode of the driving transistor, so that the voltage of the control electrode of the driving transistor reaches a preset initial voltage and the pixel circuit is reset. In this way, the pixel circuit can alleviate the hysteresis phenomenon of the driving transistor, and thus the display panel adopting the pixel circuit can avoid the problem of display afterimage due to the hysteresis phenomenon of the driving transistors in the sub-pixel units. In the above embodiment, examples of the initial signal (comprising the excitation pulse and the initial voltage) applied to the control electrode of the driving transistor by the reset circuit may refer to, for example, FIGS. 4A to 5B.

Figure 3A:
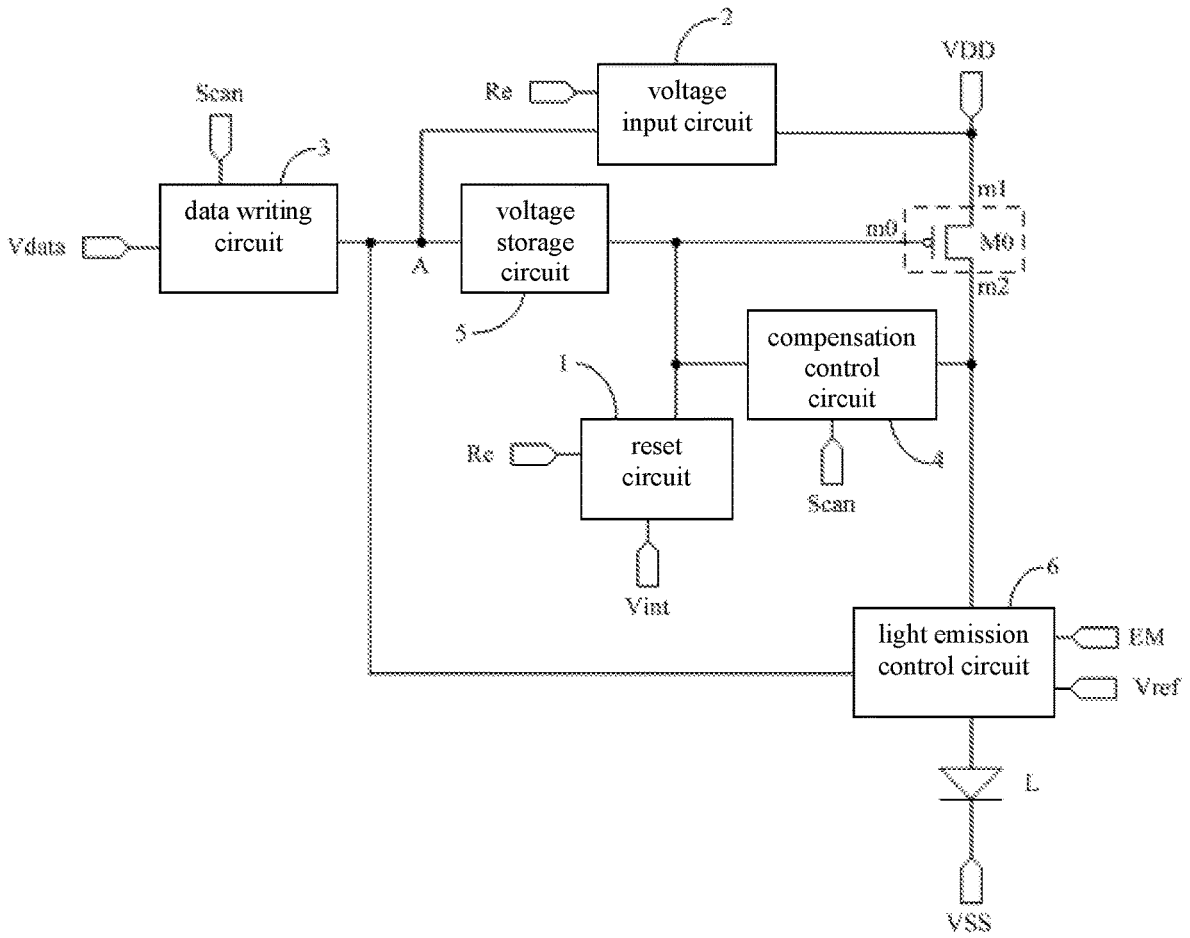
FIG. 3A is a first structural schematic diagram of a pixel circuit provided by another embodiment of the present disclosure.
Figure 3B:
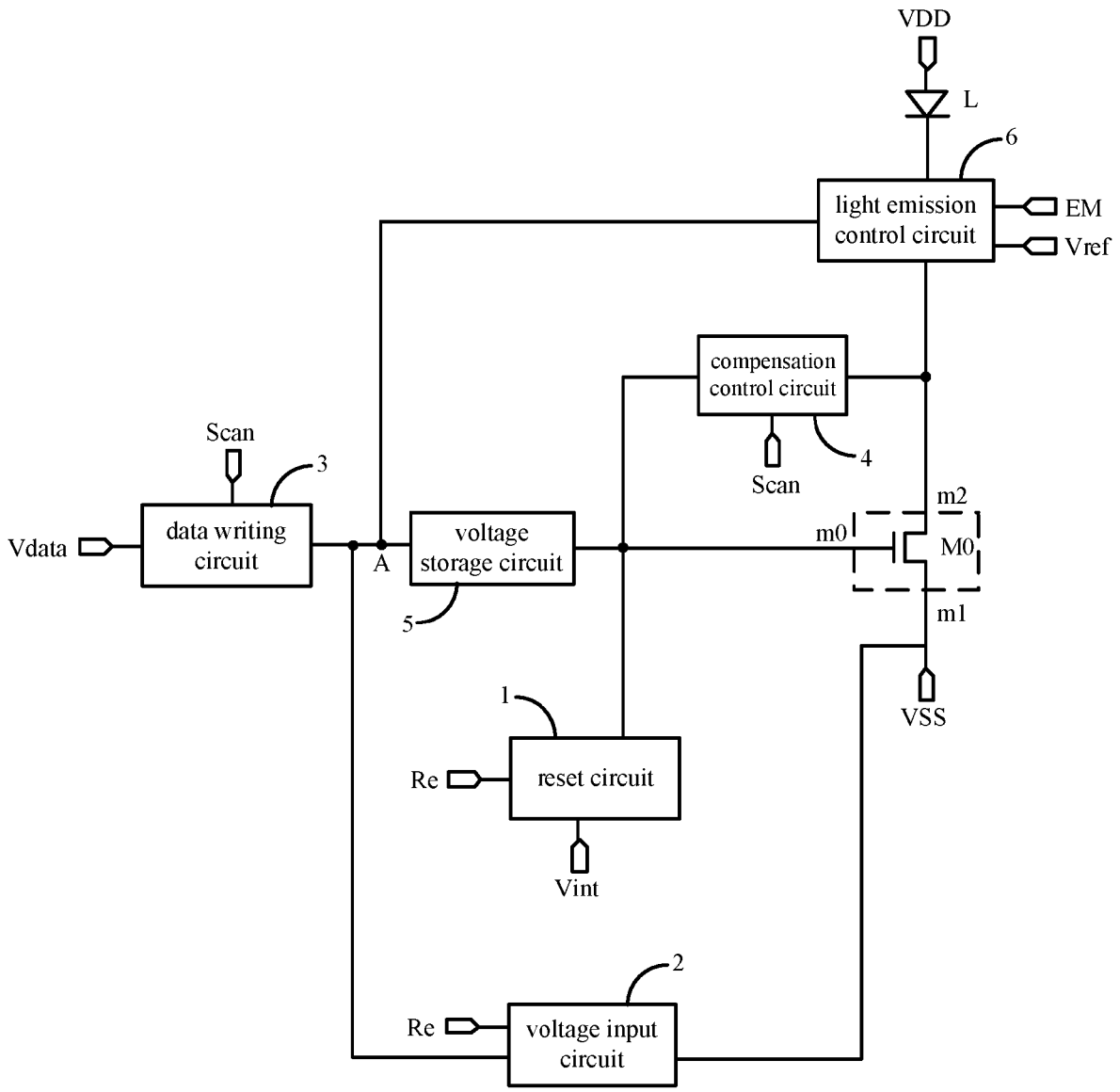
FIG. 3B is a second structural schematic diagram of a pixel circuit provided by the another embodiment of the present disclosure.

As illustrated in FIGS. 3A and 3B, a pixel circuit in another embodiment of the present disclosure is a variation of the pixel circuit in the embodiment illustrated in FIGS. 2A and 2B. As illustrated in the drawings, the pixel circuit of the embodiment comprises the reset circuit 1, a voltage input circuit 2, the data writing circuit 3, a compensation control circuit 4, a voltage storage circuit 5, a light emission control circuit 6, the driving transistor M0, a first node A and the light emitting device L. The pixel circuit, for example, may be used for the sub-pixel unit of an AMOLED display panel, and the light emitting device is an OLED at present. Similarly, in the example of FIG. 3A, the driving transistor M0 is a P-type transistor, and for example, the light emitting devices L in the pixel circuits in different sub-pixel units have a common anode. In the example of FIG. 3B, the driving transistor M0 is an N-type transistor, and for example, the light emitting devices L in the pixel circuits in different sub-pixel units have a common cathode.

It should be noted that the "first node" herein does not refer to a specific component in the pixel circuit, but is used to refer to the confluent point of different circuit branches in the circuit, for example, it may comprise a segment of the circuit.

In the example of FIG. 3A, the first electrode m1 of the driving transistor M0 is connected to the power supply terminal VDD, and the first terminal of the light emitting device L is connected to the power supply terminal VSS.

The reset circuit 1 is configured to provide the initial signal Vint having the excitation pulse to the control electrode m0 of the driving transistor M0 under control of the reset signal Re, and provide the initial signal Vint having the preset voltage to the control electrode m of the driving transistor M0 after a preset duration. There is a voltage difference between the voltage (amplitude) of the excitation pulse and the preset voltage.

The voltage input circuit 2 is configured to provide a voltage signal of the power supply terminal VDD to the first node A under control of the reset signal Re.

The data writing circuit 3 is configured to provide the data signal Vdata to the first node A under control of the scanning signal Scan.

The compensation control circuit 4 is configured to electrically conduct the control electrode m0 of the driving transistor M0 and the second electrode m2 of the driving transistor M0 under control of the scanning signal Scan, thereby controlling the driving transistor M0 to be in a diode state.

The voltage storage circuit 5 is configured to charge or discharge under control of the signal of the first node A and a signal of the control electrode m0 of the driving transistor M0, and keep the voltage difference between the first node A and the control electrode m0 of the driving transistor M0 stable when the control electrode m0 of the driving transistor M0 is in a floating state.

The light emission control circuit 6 is configured, under control of a light emission control signal EM, to provide a reference signal Vref to the first node A and provide a signal of the second electrode m2 of the driving transistor M0 to the second terminal of the light emitting device L, so as to control the driving transistor M0 to drive the light emitting device L to emit light.

In the example of FIG. 3B, the first electrode m1 of the driving transistor M0 is connected to the power supply terminal VSS, and the first terminal of the light emitting device L is connected to the power supply terminal VDD.

Similarly, the reset circuit 1 is configured to provide the initial signal Vint having the excitation pulse to the control electrode m0 of the driving transistor M0 under control of the reset signal Re, and provide the initial signal Vint having the preset voltage to the control electrode m0 of the driving transistor M0 after a preset duration. There is a voltage difference between the voltage of the excitation pulse and the preset voltage.

The voltage input circuit 2 is configured to provide a voltage signal of the power supply terminal VSS to the first node A under control of the reset signal Re.

The data writing circuit 3 is configured to provide the data signal Vdata to the first node A under control of the scanning signal Scan.

The compensation control circuit 4 is configured to electrically conduct the control electrode m0 of the driving transistor M0 and the second electrode m2 of the driving transistor M0 under control of the scanning signal Scan, thereby controlling the driving transistor M0 to be in a diode state.

The voltage storage circuit 5 is configured to charge or discharge under control of the signal of the first node A and the signal of the control electrode m0 of the driving transistor M0, and keep the voltage difference between the first node A and the control electrode m0 of the driving transistor M0 stable when the control electrode m0 of the driving transistor M0 is in the floating state.

The light emission control circuit 6 is configured, under control of the light emission control signal EM, to provide the reference signal Vref to the first node A and provide the signal of the second electrode m2 of the driving transistor M0 to the second terminal of the light emitting device L, so as to control the driving transistor M0 to drive the light emitting device L to emit light.

In FIG. 3A, for example, the high voltage power supply terminal VDD and the low voltage power supply terminal VSS respectively serve as examples of the first power supply terminal and the second power supply terminal in the embodiment. In FIG. 3B, for example, the high voltage power supply terminal VDD and the low voltage power supply terminal VSS respectively serve as examples of the second power supply terminal and the first power supply terminal in the embodiment.

The above pixel circuit provided by the above embodiment of the present disclosure comprises: the reset circuit, the voltage input circuit, the data writing circuit, the compensation control circuit, the voltage storage circuit, the light emission control circuit, the driving transistor and the light emitting device. In operation, the pixel circuit provides the initial signal having the excitation pulse to the control electrode of the driving transistor through the reset circuit in advance, so the voltage of the control electrode of the driving transistor is significantly changed, thereby rapidly eliminating the voltage information of the driving transistor of the pixel circuit remaining from the last time of light emitting (e.g., the previous frame display of the display panel). And then the initial signal having the preset voltage is provided to the control electrode of the driving transistor after the preset duration, so that the voltage of the control electrode of the driving transistor reaches the preset initial voltage and the pixel circuit is reset. In this way, the pixel circuit can alleviate the hysteresis phenomenon of the driving transistor, and thus the display panel adopting the pixel circuit can avoid the problem of display afterimage due to the hysteresis phenomenon of the driving transistors in the sub-pixel units.

In this embodiment, through the cooperation of the above six circuits and the driving transistor, the pixel circuit can further enable the operation electric current of the driving transistor in the pixel circuit for driving the light emitting device to emit light to be relevant to the voltage of the data signal Vdata and the voltage of the reference signal Vref only, but not relevant to the threshold voltage Vth of the driving transistor and the voltage of the first power supply terminal, thereby avoiding the influence of the threshold voltage of the driving transistor and the IR drop on the operation electric current flowing through the light emitting device, realizing the compensation for the IR drop and the voltage drop from the first voltage terminal, so that the operation electric current for driving the light emitting device to emit light is maintained stable, and the uniformity of the luminance of the image in the display area in the display device adopting the pixel circuit can be improved.

In the above pixel circuit provided by at least one embodiment of the present disclosure, the first terminal of the light emitting device is a cathode, and the second terminal of the light emitting device is an anode. In addition, the light emitting device may be an organic light emitting diode and emits light under control of the driving electric current of the driving transistor when the driving transistor is in a saturation state.

In the above pixel circuit provided by at least one embodiment of the present disclosure, the voltage $V_{dd}$ of the high voltage power supply terminal VDD generally is a positive value, and the voltage $V_{ref}$ of the reference signal generally is a positive value. The voltage Vss of the low voltage power supply terminal VSS generally is grounded or a negative value, but may also be a positive value.

As described above, in at least one example, in the above pixel circuit provided by an embodiment of the present disclosure, as illustrated in FIGS. 2A and 3A, the driving transistor M0 may be a P-type transistor. A gate electrode of the P-type transistor is the control electrode m0 of the driving transistor M0, a source electrode thereof is the first electrode in of the driving transistor M0, and a drain electrode thereof is the second electrode m2 of the driving transistor M0. When the P-type transistor is in the saturation state, the electric current flows from the source electrode of the P-type transistor to the drain electrode of the P-type transistor. The threshold voltage $V_{th}$ of the P-type transistor generally is a negative value, and its width to length ratio is relatively small while its equivalent resistance is large. For example, a preset voltage $V_{int}(0)$ of the initial signal and the voltage $V_{dd}$ of the power supply terminal need to meet the formula: $V_{int}(0)<V_{dd}+V_{th}$.

Figure 4A:
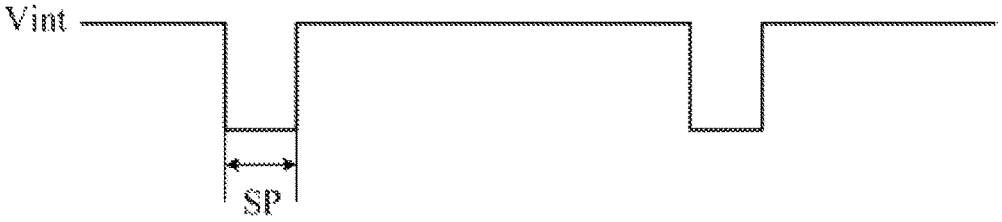
FIG. 4A is a first schematic diagram of an initial signal provided by an embodiment of the present disclosure.

In at least one example, in the above pixel circuit provided by an embodiment of the present disclosure, as illustrated in FIG. 4A, when the driving transistor M0 is a P-type transistor, the excitation pulse SP of the initial signal $V_{int}$ is an excitation pulse having a negative voltage, i.e., the effective voltage $V_{int}(SP)$ of the excitation pulse SP is less than the preset voltage $V_{int}(0)$. For example, in a specific example, the preset voltage $V_{int}(0)$ is, for example, 0V, and the effective voltage of the excitation pulse SP may be −8V. Of course, the effective voltage of the excitation pulse SP may also be set as other voltages that meet the conditions, which is not limited in this embodiment.

Figure 5A:
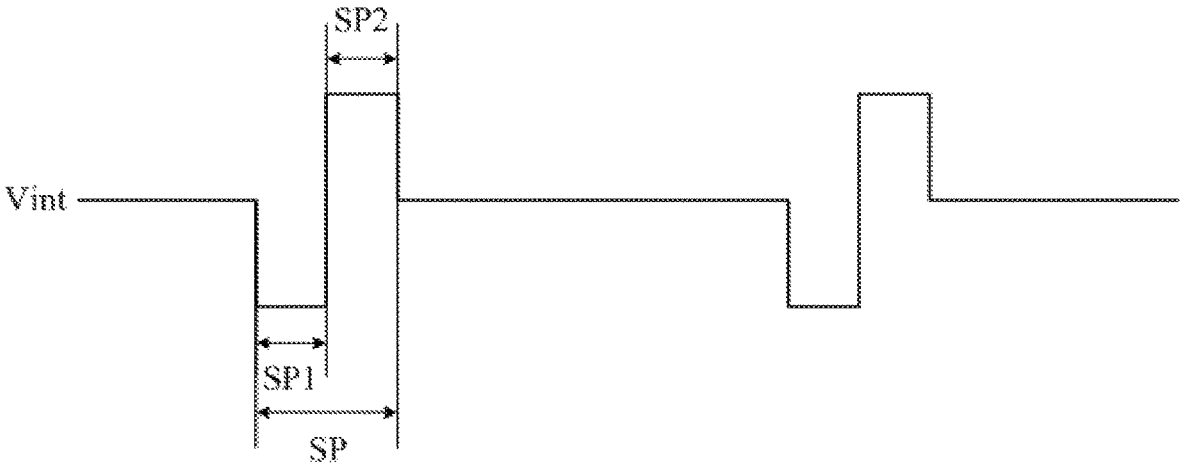
FIG. 5A is a third schematic diagram of an initial signal provided by the embodiment of the present disclosure.

Alternatively, in order to better alleviate the hysteresis phenomenon of the driving transistor M0, as illustrated in FIG. 5A, the excitation pulse SP comprises an excitation sub-pulse SP1 having a negative voltage and an excitation sub-pulse SP2 having a positive voltage. When the driving transistor M0 is a P-type transistor, the excitation pulse SP first is the excitation sub-pulse SP1 having the negative voltage, and then is the excitation sub-pulse SP2 having the positive voltage. For example, in a specific example, the preset voltage $V_{int}(0)$ is 0V, the effective voltage of the excitation sub-pulse SP1 having the negative voltage may be −8V, and the effective voltage of the excitation sub-pulse SP2 having the positive voltage may be 8V. Of course, in another specific example, the preset voltage $V_{int}(0)$ is 0V, the effective voltage of the excitation sub-pulse SP1 having the negative voltage may be −5V, and the effective voltage of the excitation sub-pulse SP2 having the positive voltage may be 8V. Of course, the effective voltage of the excitation sub-pulse SP2 having the positive voltage and the effective voltage of the excitation sub-pulse SP1 having the negative voltage may also be set as other voltages that meet the above conditions, which is not limited in this embodiment.

In addition, as illustrated in FIGS. 4A and 5A, the initial signal $V_{int}$ having the excitation pulse SP and the preset voltage $V_{int}(0)$ may also be a periodic signal. For example, each period comprises an excitation pulse portion and a subsequent horizontal voltage portion having a relatively lower voltage, and the duration of each period is the duration of scanning one row of pixel circuits by the display panel comprising a plurality of rows of sub-pixel units in a row-by-row scanning process.

In at least one embodiment, as illustrated in FIG. 2B, the driving transistor M0 may also be an N-type transistor. A gate electrode of the N-type transistor is the control electrode m0 of the driving transistor M0, a source electrode thereof is the first electrode m1 of the driving transistor M0, and a drain electrode thereof is the second electrode m2 of the driving transistor M0. When the N-type transistor is in the saturation state, the electric current flows from the drain electrode of the N-type transistor to the source electrode of the N-type transistor. The threshold voltage $V_{th}$ of the N-type transistor generally is a positive value, and its width to length ratio is relatively small while its equivalent resistance is large. For example, the preset voltage $V_{int}(0)$ of the initial signal and the voltage Vs of the power supply terminal need to meet the formula: $V_{int}(0)>V_{ss}+V_{th}$.

Figure 4B:
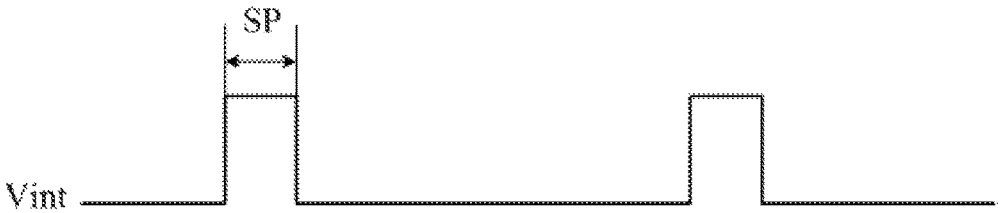
FIG. 4B is a second of schematic diagram of an initial signal provided by the embodiment of the present disclosure.

In at least one example, in the above pixel circuit provided by an embodiment of the present disclosure, as illustrated in FIG. 4B, when the driving transistor M0 is an N-type transistor, the excitation pulse SP of the initial signal is an excitation pulse having a positive voltage, i.e., the effective voltage $V_{int}$(SP) of the excitation pulse SP is greater than the preset voltage $V_{int}(0)$. For example, in a specific example, the preset voltage $V_{int}(0)$ is 3V, and the effective voltage of the excitation pulse SP may be 8V. Of course, the effective voltage of the excitation pulse SP may also be set as other voltages that meet the above conditions, which is not limited herein.

Figure 5B:
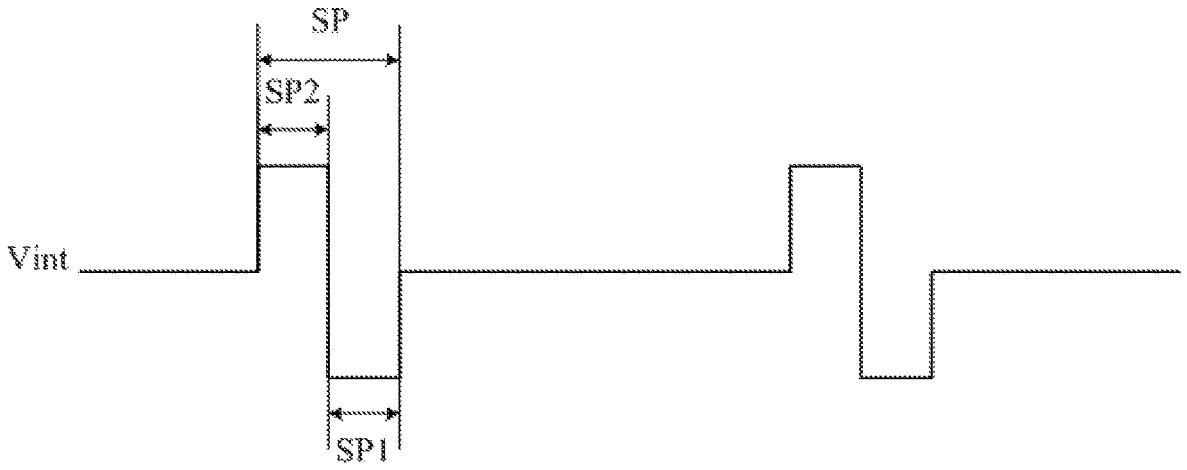
FIG. 5B is a fourth schematic diagram of an initial signal provided by the embodiment of the present disclosure.

Alternatively, in order to better alleviate the hysteresis phenomenon of the driving transistor M0, as illustrated in FIG. 5B, the excitation pulse SP comprises the excitation sub-pulse SP1 having the negative voltage and the excitation sub-pulse SP2 having the positive voltage. When the driving transistor M0 is an N-type transistor, the excitation pulse SP first is the excitation sub-pulse SP2 having the positive voltage, and then is the excitation sub-pulse SP1 having the negative voltage. For example, in a specific example, the preset voltage $V_{int}(0)$ is 3V, the effective voltage of the excitation sub-pulse SP1 having the negative voltage may be −8V, and the effective voltage of the excitation sub-pulse SP2 having the positive voltage may be 8V. Of course, the preset voltage $V_{int}(0)$ may also be 3V, the effective voltage of the excitation sub-pulse SP1 having the negative voltage may be −5V, and the effective voltage of the excitation sub-pulse SP2 having the positive voltage may be 8V. Of course, the effective voltage of the excitation sub-pulse SP2 having the positive voltage and the effective voltage of the excitation sub-pulse SP1 having the negative voltage may also be set as other voltages that meet the above conditions, which is not limited herein. In addition, as illustrated in FIGS. 4B and 5B, the initial signal $V_{int}$ having the excitation pulse SP and the preset voltage $V_{int}(0)$ may also be a periodic signal. For example, each period comprises the excitation pulse portion and the subsequent horizontal voltage portion having the relatively lower voltage, and the duration of each period is the duration of scanning one row of pixel circuits by the display panel comprising a plurality of rows of pixel circuits.

In at least one example, in the above pixel circuit provided by an embodiment of the present disclosure, the preset duration needs to be determined according to the duration of the effective pulse signal of the reset signal in the actual application. For example, the preset duration (pulse width) of the effective pulse signal of the reset signal may be set as 1 μs, and the duration of each period of the reset signal may be 16.7 μs. Of course, the preset duration and the duration of each period may also be set as other durations, which may be determined according to the specific structure of the display panel, and it is not limited in this embodiment.

The present disclosure will be described in detail below with reference to the specific embodiments. It should be noted that the described embodiments are only for better explanation of the present disclosure, but are not used for limiting the present disclosure.

In at least one example, in the above pixel circuit provided by an embodiment of the present disclosure, as illustrated in FIGS. 6A to 7B, the reset circuit 1 may comprise a first switching transistor M1.

A control electrode of the first switching transistor M1 is configured to receive the reset signal Re, a first electrode of the first switching transistor M1 is configured to receive the initial signal $V_{int}$, and a second electrode of the first switching transistor M1 is connected to the control electrode m0 of the driving transistor M0.

Figure 6A:
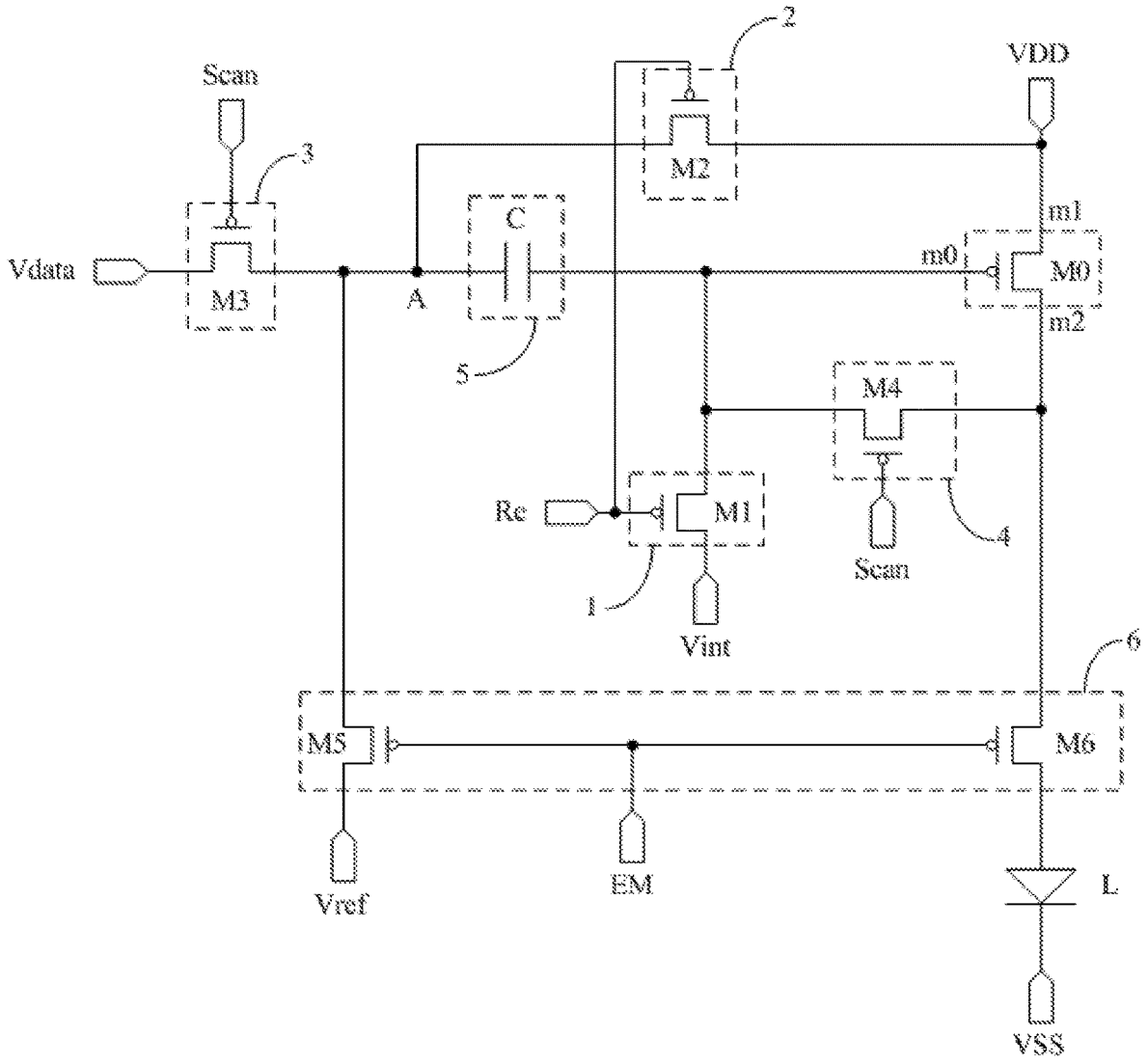
FIG. 6A is a first specific structural schematic diagram of the pixel circuit as illustrated in FIG. 3A.
Figure 6B:
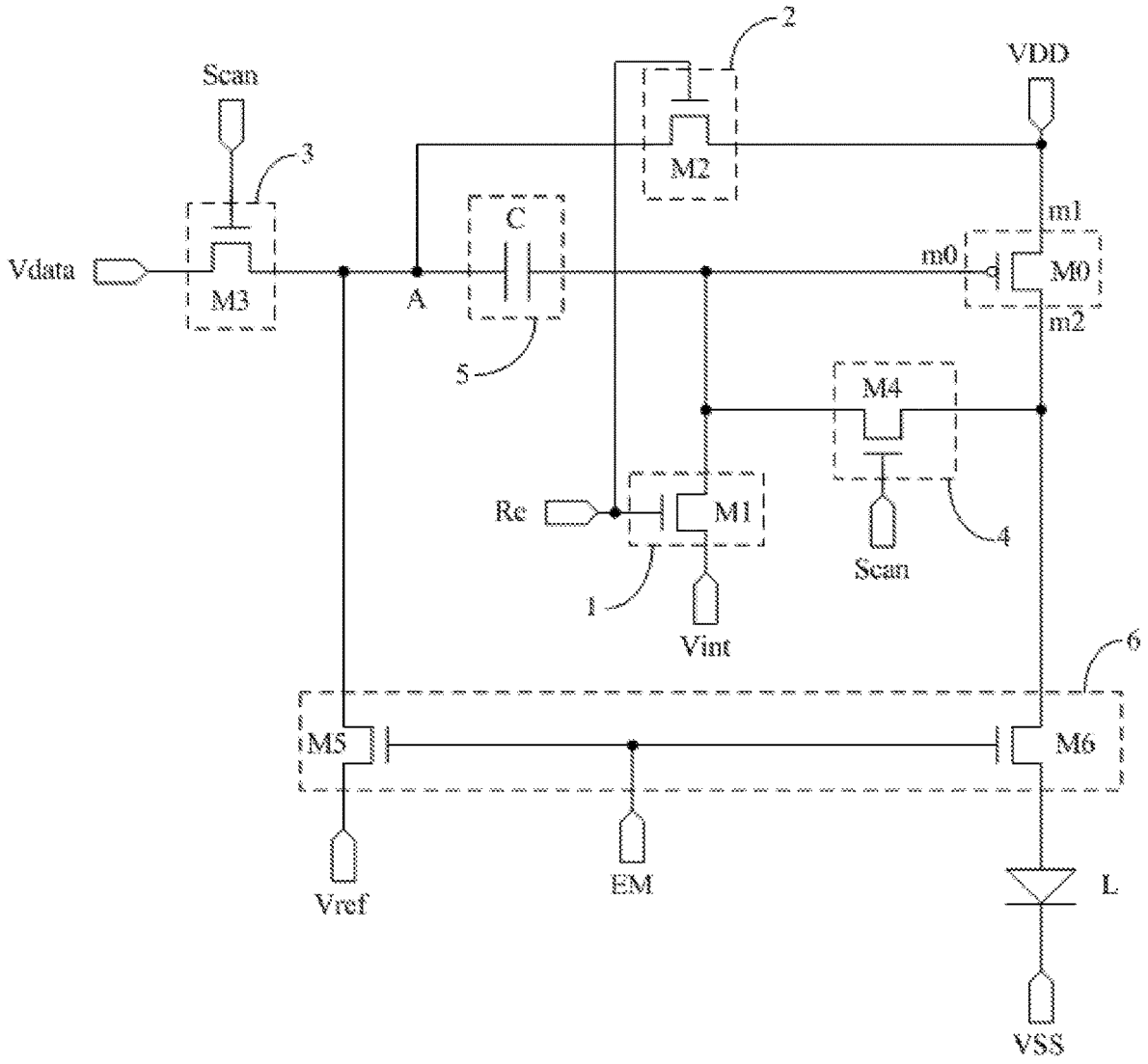
FIG. 6B is a second specific structural schematic diagram of the pixel circuit as illustrated in FIG. 3A.
Figure 7A:
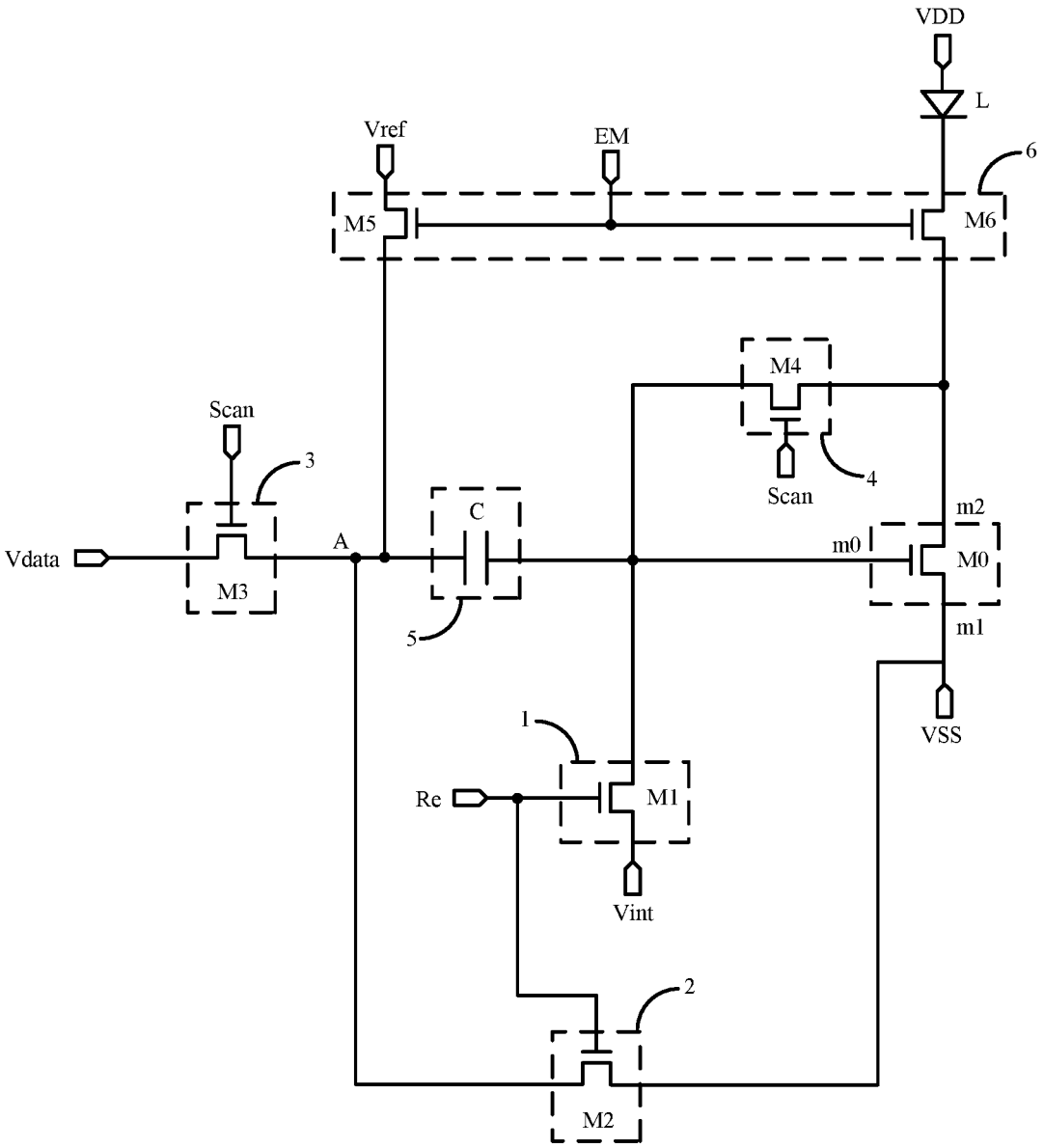
FIG. 7A is a first specific structural schematic diagram of the pixel circuit as illustrated in FIG. 3B.
Figure 7B:
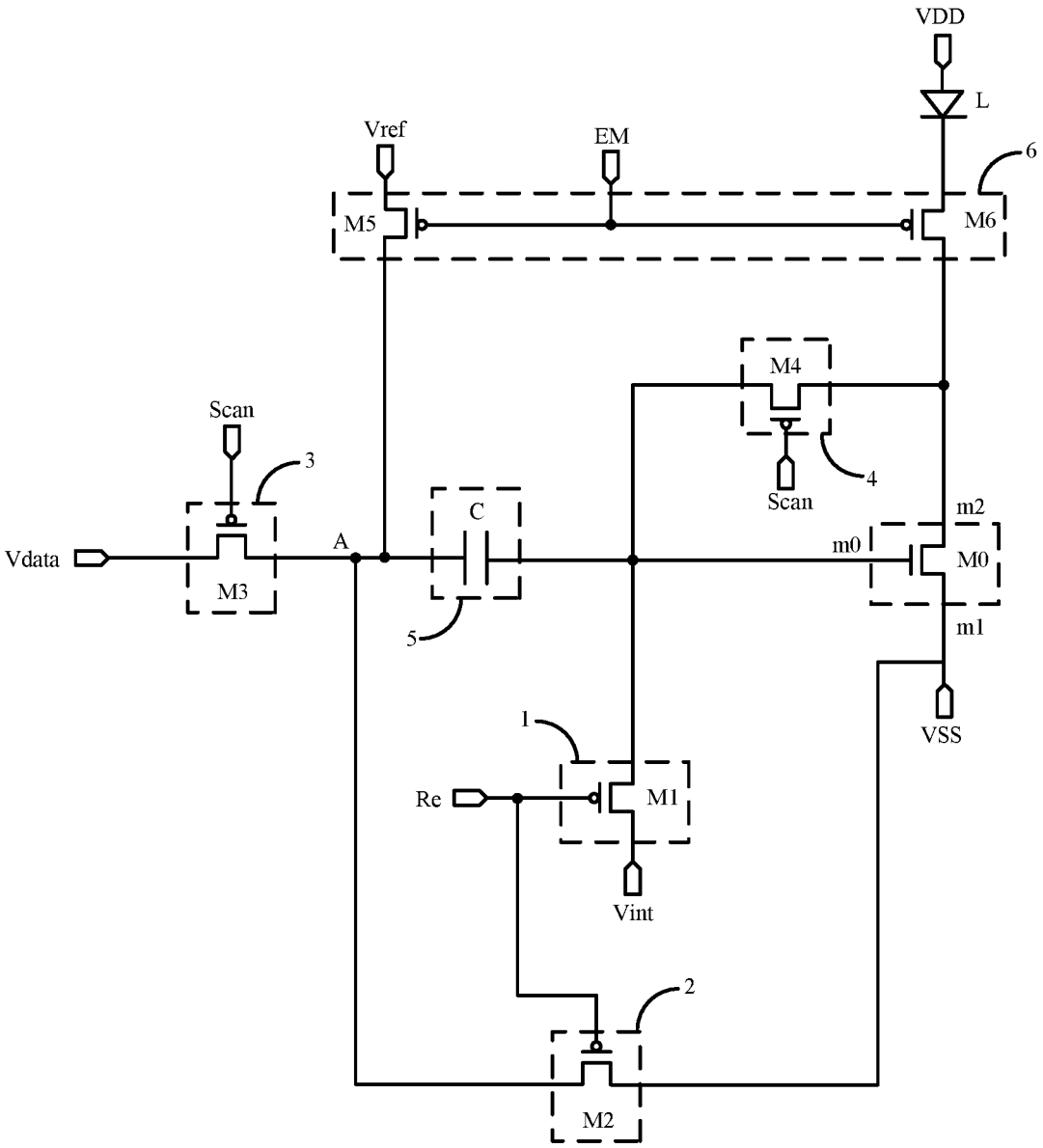
FIG. 7B is a second specific structural schematic diagram of the pixel circuit as illustrated in FIG. 3B.

In at least one example, in the pixel circuit provided by an embodiment of the present disclosure, as illustrated in FIGS. 6A and 7B, the first switching transistor M1 may be a P-type switching transistor; or as illustrated in FIGS. 6B and 7A, the first switching transistor M1 may also be an N-type switching transistor, which is not limited in this embodiment.

In at least one example, in the above pixel circuit provided by an embodiment of the present disclosure, the first switching transistor provides the initial signal to the control electrode of the driving transistor when the first switching transistor is in the turning-on state under control of the reset signal.

In at least one example, in the above pixel circuit provided by an embodiment of the present disclosure, as illustrated in FIGS. 6A and 7B, the voltage input circuit 2 may comprise a second switching transistor M2. A control electrode of the second switching transistor M2 is configured to receive the reset signal Re, a first electrode of the second switching transistor M2 is connected to the power supply terminal VDD or the power supply terminal VSS, and a second electrode of the second switching transistor M2 is connected to the first node A.

In at least one example, in the above pixel circuit provided by an embodiment of the present disclosure, as illustrated in FIGS. 6A and 7B, the second switching transistor M2 may be a P-type switching transistor; or as illustrated in FIGS. 6B and 7A, the second switching transistor M2 may also be an N-type switching transistor, which is not limited in this embodiment.

In at least one example, in the above pixel circuit provided by an embodiment of the present disclosure, the second switching transistor provides the signal of the first power supply terminal (power supply terminal VDD or VSS) to the first node when the second switching transistor is in the turning-on state under control of the reset signal.

In at least one example, in the above pixel circuit provided by an embodiment of the present disclosure, as illustrated in FIGS. 6A to 7B, the data writing circuit 3 may comprise a third switching transistor M3. A control electrode of the third switching transistor M3 is configured to receive the scanning signal Scan, a first electrode of the third switching transistor M3 is configured to receive the data signal Vdata, and a second electrode of the third switching transistor M3 is connected to the first node A.

In at least one example, in the above pixel circuit provided by an embodiment of the present disclosure, as illustrated in FIGS. 6A and 7B, the third switching transistor M3 may be a P-type switching transistor; or as illustrated in FIGS. 6B and 7A, the third switching transistor M3 may also be an N-type switching transistor, which is not limited in this embodiment.

In at least one example, in the above pixel circuit provided by an embodiment of the present disclosure, the third switching transistor M3 provides the data signal to the first node when the third switching transistor M3 is in the turning-on state under control of the scanning signal.

In at least one example, in the above pixel circuit provided by an embodiment of the present disclosure, as illustrated in FIGS. 6A to 7B, the compensation control circuit 4 may comprise a fourth switching transistor M4. A control electrode of the fourth switching transistor M4 is configured to receive the scanning signal Scan, a first electrode of the fourth switching transistor M4 is connected to the control electrode m0 of the driving transistor M0, and a second electrode of the fourth switching transistor M4 is connected to the second electrode m2 of the driving transistor M0. For example, the control electrode of the fourth switching transistor M4 and the control electrode of the third switching transistor M3 may be connected to a same scanning line (gate line).

In at least one example, in the above pixel circuit provided by an embodiment of the present disclosure, as illustrated in FIGS. 6A and 7B, the fourth switching transistor M4 may be a P-type switching transistor; or as illustrated in FIGS. 6B and 7A, the fourth switching transistor M4 may also be an N-type switching transistor, which is not limited in this embodiment.

In at least one example, in the above pixel circuit provided by an embodiment of the present disclosure, the fourth switching transistor electrically conduct the control electrode of the driving transistor and the second electrode of the driving transistor when the fourth switching transistor is in the turning-on state under control of the scanning signal. Because the control electrode of the driving transistor is connected to the second electrode of the driving transistor, the driving transistor may be in the diode state.

In at least one example, in the above pixel circuit provided by an embodiment of the present disclosure, as illustrated in FIGS. 6A to 7B, the light emission control circuit 6 may comprise a reference voltage control sub-circuit and a light-emitting electric current control sub-circuit. The reference voltage control sub-circuit and the light-emitting electric current control sub-circuit respectively comprise a fifth switching transistor M5 and a sixth switching transistor M6. A control electrode of the fifth switching transistor M5 is configured to receive the light emission control signal EM, a first electrode of the fifth switching transistor M5 is configured to receive the reference signal Vref, and a second electrode of the fifth switching transistor M5 is connected to the first node A. A control electrode of the sixth switching transistor M6 is configured to receive the light emission control signal EM, a first electrode of the sixth switching transistor M6 is connected to the second electrode m2 of the driving transistor M0, and a second electrode of the sixth switching transistor M6 is connected to the second terminal of the light emitting device L. In at least one example, the reference voltage control sub-circuit and the light-emitting electric current control sub-circuit may also be connected to different control lines, for example, the control electrode of the fifth switching transistor M5 and the control electrode of the sixth switching transistor M6 may also be connected to different control lines, so as to receive the same or different control signals, thereby enabling the reference voltage control sub-circuit and the light-emitting electric current control sub-circuit to operate independently.

In at least one example, in the above pixel circuit provided by an embodiment of the present disclosure, as illustrated in FIGS. 6A and 7B, the fifth switching transistor M5 and the sixth switching transistor M6 may be P-type switching transistors; or as illustrated in FIGS. 6B and 7A, the fifth switching transistor M5 and the sixth switching transistor M6 may also be N-type switching transistors, which is not limited in this embodiment.

In at least one example, in the above pixel circuit provided by an embodiment of the present disclosure, the fifth switching transistor provides the reference signal to the first node when the fifth switching transistor is in the turning-on state under control of the light emission control signal. The sixth switching transistor may electrically conduct the second electrode of the driving transistor and the second terminal of the light emitting device when the sixth switching transistor is in the turning-on state under control of the light emission control signal, so as to provide the signal of the second electrode of the driving transistor to the second terminal of the light emitting device, thereby enabling the driving electric current flowing through the driving transistor to flow pass the light emitting device to drive the light emitting device to emit light.

In at least one example, in the above pixel circuit provided by an embodiment of the present disclosure, as illustrated in FIGS. 6A to 7B, the voltage storage circuit 5 may comprise at least one capacitor C. A first terminal of the capacitor C is connected to the first node A, and a second terminal of the capacitor C is connected to the control electrode m0 of the driving transistor M0.

In at least one example, in the above pixel circuit provided by an embodiment of the present disclosure, the capacitor C charges under control of both the signal of the first node and the signal of the control electrode of the driving transistor, discharges under control of both the signal of the first node and the signal of the control electrode of the driving transistor, and keeps the voltage difference between the first node and the control electrode of the driving transistor stable when the control electrode of the driving transistor is in the floating state, so the threshold voltage VW of the driving transistor and the voltage $V_{dd}$ or $V_{ss}$ of the first power supply terminal are stored in the control electrode of the driving transistor, so as to control the value of the driving electric current flowing through the driving transistor in the later light emitting phase, thereby controlling the luminous intensity of the light emitting device.

The above are merely examples to illustrate the specific implementations of the reset circuit, the voltage input circuit, the data writing circuit, the compensation control circuit, the voltage storage circuit and the light emission control circuit in the pixel circuit provided by an embodiment of the present disclosure. The specific structures of the reset circuit, the voltage input circuit, the data writing circuit, the compensation control circuit, the voltage storage circuit and the light emission control circuit are not limited to the above structures provided by an embodiment of the present disclosure, and may also be other structures as known by those skilled in the related art, which are not limited in the embodiment.

Further, in order to simplify the manufacturing process of the pixel circuit, in at least one example, in the above pixel circuit provided by an embodiment of the present disclosure, as illustrated in FIG. 6A, when the driving transistor M0 is a P-type transistor, all the switching transistors may be P-type switching transistors. Or as illustrated in FIG. 7A, when the driving transistor M0 is an N-type transistor, all the switching transistors may be N-type switching transistors, which is not limited in the embodiment. That is, the transistors in each circuit can be selected according to the needs, and then the control signals are selected accordingly.

In at least one example, in the above pixel circuit provided by an embodiment of the present disclosure, the P-type switching transistor turns off under control of a high potential and turns on under control of a low potential, and the N-type switching transistor turns on under control of a high potential and turns off under control of a low potential.

In the above pixel circuit provided by an embodiment of the present disclosure, it should be noted that the driving transistor and the switching transistor may be thin film transistors (TFTs) or metal oxide semiconductors (MOSs), which are not limited herein. The control electrode of the switching transistor is used as the gate electrode of the switching transistor. These switch transistors may use the first electrode as the source electrode or the drain electrode of the switching transistors and use the second electrode as the drain electrode or the source electrode of the switching transistors, according to the types of the switching transistors and the signals of the signal terminals, which is not limited herein. And in the description of the specific embodiments, it is illustrated as an example that the driving transistor and the switching transistor are thin film transistors, but it is not limited in the embodiment.

The working process of the above pixel circuit provided by an embodiment of the present disclosure is described below in combination with the circuit timing diagram, and the pixel circuit illustrated in FIGS. 6A and 7A is taken as an example. In the following description, "1" represents a high potential and "0" represents a low potential. Here it should be noted that "1" and "0" are logic potentials in the present disclosure, which are only used to better explain the specific working process of the embodiment of the present disclosure, rather than the potentials applied to the control electrode of each switching transistor in the specific implementation.

First Embodiment

Figure 8A:
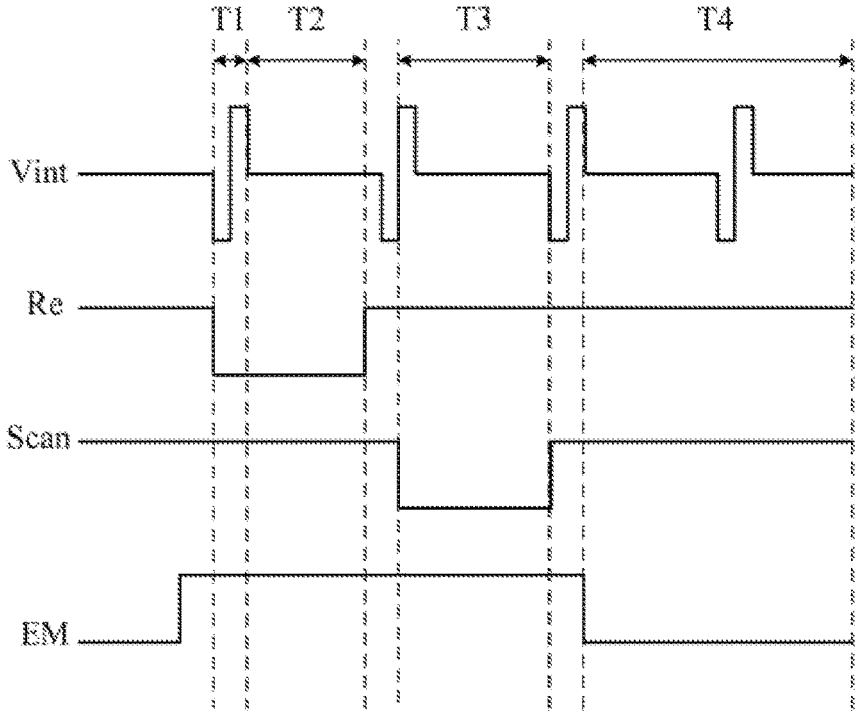
FIG. 8A is a circuit timing diagram of the pixel circuit as illustrated in FIG. 6A.

As illustrated in FIG. 6A, the driving transistor M0 is a P-type transistor, and all the switching transistors are P-type transistors. Taking the initial signal $V_{int}$ illustrated in FIG. 5A as an example, the corresponding circuit timing diagram is illustrated in FIG. 8A. For example, four phases, that is, T1, T2, T3, and T4 in one drive period in the input timing diagram as illustrated in FIG. 8A are selected.

In the phase T1, the scanning signal Scan=1, the reset signal Re=0, and the light emission control signal EM1=1.

The first switching transistor M1 and the second switching transistor M2 are turned on due to Re=0. The third switching transistor M3 and the fourth switching transistor M4 are turned off due to Scan=1. The fifth switching transistor M5 and the sixth switching transistor M6 are turned off due to EM1=1. The turned-on second switching transistor M2 provides the signal of the power supply terminal VDD to the first node. The turned-on first switching transistor M1 provides the initial signal $V_{int}$ (AC signal) having the excitation pulse to a gate electrode of the driving transistor M0 to excite the voltage of the gate electrode of the driving transistor M0, so the voltage of the gate electrode of the driving transistor M0 tends to a target voltage value, thereby rapidly eliminating the residual state in the previous light emitting phase. The voltage between the two terminals of the capacitor C is reset according to the signal of the first node A and the initial signal of the gate electrode of the driving transistor M0.

In the phase T2, the scanning signal Scan=1, the reset signal Re=0, and the light emission control signal EM1=1.

The first switching transistor M1 and the second switching transistor M2 are turned on due to Re=0. The third switching transistor M3 and the fourth switching transistor M4 are turned off due to Scan=1. The fifth switching transistor M5 and the sixth switching transistor M6 are turned off due to EM1=1. The turned-on second switching transistor M2 provides the signal of the power supply terminal VDD to the first node A. The turned-on first switching transistor M1 provides the initial signal $V_{int}$ (DC signal) having the preset voltage $V_{int}t(0)$ to the gate electrode of the driving transistor M0 to reset the gate electrode of the driving transistor M0, and accordingly, the voltage between the two terminals of the capacitor C is continuously reset.

In the phase T3, the scanning signal Scan=0, the reset signal Re=1, and the light emission control signal EM1=1.

The third switching transistor M3 and the fourth switching transistor M4 are turned on due to Scan=0. The first switching transistor M1 and the second switching transistor M2 are turned off due to Re=1. The fifth switching transistor M5 and the sixth switching transistor M6 are turned off due to EM1=1. The turned-on third switching transistor M3 provides the data signal Vdata to the first node A, so the voltage of the first node A is $V_{data}$, i.e., the voltage of the first terminal of the capacitor C is $V_{data}$. The turned-on fourth switching transistor M4 electrically conducts the gate electrode of the driving transistor M0 and the drain electrode of the driving transistor M0, so as to control the driving transistor M0 to be in the diode state. Because the driving transistor M0 which is in the state of diode connection and the turned-on fourth switching transistor M4 can enable the power supply terminal VDD to charge the capacitor C until the voltage of the gate electrode of the driving transistor M0 changes to $V_{dd}+V_{th}$, i.e., the voltage of the second terminal of the capacitor C is $V_{dd}+V_{th}$. At present, the voltage difference between the two terminals of the capacitor C is: $V_{data}-V_{dd}-V_{th}$.

In the phase T4, the scanning signal Scan=1, the reset signal Re=1, and the light emission control signal EM1=0.

The fifth switching transistor M5 and the sixth switching transistor M6 are turned on due to EM1=0. The third switching transistor M3 and the fourth switching transistor M4 are turned off due to Scan=1. The first switching transistor M1 and the second switching transistor M2 are turned off due to Re=1. The turned-on fifth switching transistor M5 provides the reference signal Vref to the first node A, so the voltage of the first node A is $V_{ref}$. Because both the first switching transistor M1 and the fourth switching transistor M4 are turned off, the gate electrode of the driving transistor M0 is in the floating state, i.e., the second terminal of the capacitor C is in the floating state. According to the law of charge conservation for the charge of the capacitor C before and after the jump, in order to maintain the voltage difference between the two terminals of the capacitor C to be still $V_{data}-V_{dd}-V_{th}$, the voltage of the second terminal of the capacitor C jumps to $V_{ref}-V_{data}+V_{dd}+V_{th}$, i.e., the voltage of the gate electrode of the driving transistor M0 is $V_{ref}-V_{data}+V_{dd}+V_{th}$. At present, the driving transistor M0 is in the saturation state, and the voltage of the source electrode of the driving transistor M0 is $V_{dd}$. According to the electric current characteristics of the saturation state, the operating electric current $I_L$ which flows through the driving transistor M0 and is used to drive the light emitting device L to emit light meets the following formula:

$$I_L=K(V_{gs}-V_{th})^2=K[(V_{ref}-V_{data}+V_{dd}+V_{th}-V_{dd})-V_{th}]^2=K(V_{ref}-V_{data})^2,$$

wherein $V_{gs}$ is the voltage between the gate electrode and the source electrode of the driving transistor M0; and K is a structure parameter and this value is relatively stable in the same structure and therefore can be regarded as a constant value.

It can be known from the above formula that the electric current of the driving transistor M0 when it is in the saturation state is only relevant to the voltage $V_{ref}$ of the reference signal $V_{ref}$ and the voltage $V_{da}$a of the data signal $V_{data}$, and is not relevant to the threshold voltage $V_{th}$ of the driving transistor M0 and the voltage $V_{dd}$ of the power supply terminal VDD. The problem that the threshold voltage $V_{th}$ drifts due to the formation process of the driving transistor M0 and the long-time operation can be solved, and the influence of the IR drop on the electric current flowing through the light emitting device can be avoided, so the operating electric current of the light emitting device L can be kept stable to achieve light emission stability.

Second Embodiment

Figure 8B:
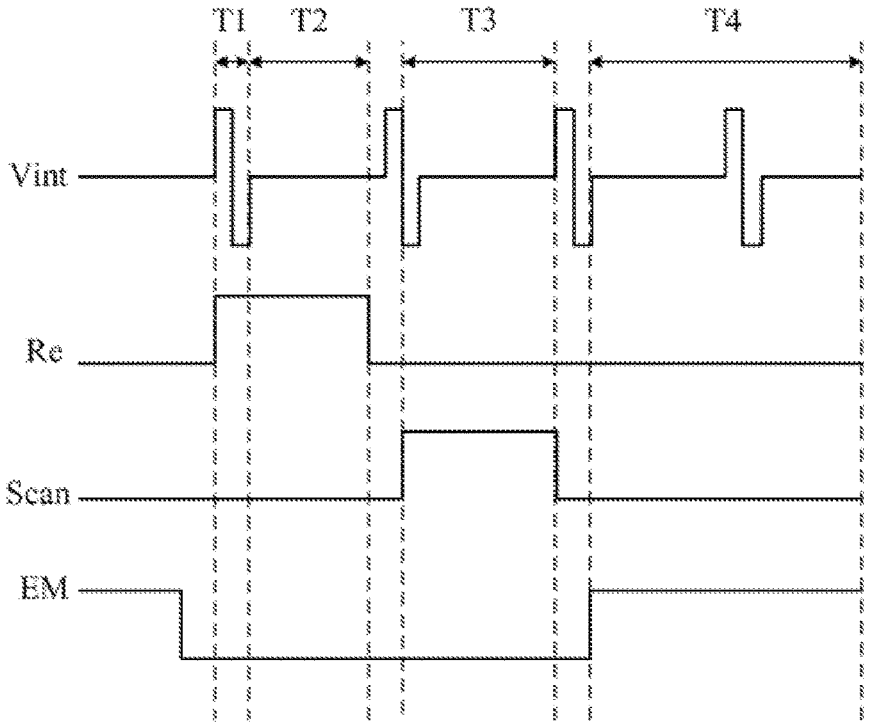
FIG. 8B is a circuit timing diagram of the pixel circuit as illustrated in FIG. 7A.

As illustrated in FIG. 7A, the driving transistor M0 is an N-type transistor, and all the switching transistors are N-type transistors. Taking the initial signal $V_{int}$ illustrated in FIG. 5B as an example, the corresponding circuit timing diagram is illustrated in FIG. 8B. For example, four phases, that is, T1, T2, T3, and T4 in one drive period in the input timing diagram as illustrated in FIG. 8B are selected.

In the phase T, the scanning signal Scan=0, the reset signal Re=1, and the light emission control signal EM1=0.

The first switching transistor M1 and the second switching transistor M2 are turned on due to Re=1. The third switching transistor M3 and the fourth switching transistor M4 are turned off due to Scan=0. The fifth switching transistor M5 and the sixth switching transistor M6 are turned off due to EM1=0. The turned-on second switching transistor M2 provides the signal of the power supply terminal VSS to the first node. The turned-on first switching transistor M1 provides the initial signal $V_{int}$ (AC signal) having the excitation pulse to the gate electrode of the driving transistor M0 to excite the voltage of the gate electrode of the driving transistor M0, so the voltage of the gate electrode of the driving transistor M0 tends to the target voltage value, thereby rapidly eliminating the residual state in the previous light emitting phase. The voltage between the two terminals of the capacitor C is reset according to the signal of the first node A and the initial signal of the gate electrode of the driving transistor M0.

In the phase T2, the scanning signal Scan=0, the reset signal Re=1, and the light emission control signal EM1=0.

The first switching transistor M1 and the second switching transistor M2 are turned on due to Re=1. The third switching transistor M3 and the fourth switching transistor M4 are turned off due to Scan=0. The fifth switching transistor M5 and the sixth switching transistor M6 are turned off due to EM0. The turned-on second switching transistor M2 provides the signal of the power supply terminal VSS to the first node A. The turned-on first switching transistor M1 provides the initial signal $V_{int}$ (DC signal) having the preset voltage $V_{int}(0)$ to the gate electrode of the driving transistor M0 to reset the gate electrode of the driving transistor M0.

In the phase T3, the scanning signal Scan=1, the reset signal Re=0, and the light emission control signal EM1=0.

The third switching transistor M3 and the fourth switching transistor M4 are turned on due to Scan=1. The first switching transistor M1 and the second switching transistor M2 are turned off due to Re=0. The fifth switching transistor M5 and the sixth switching transistor M6 are turned off due to EM1=0. The turned-on third switching transistor M3 provides the data signal $V_{data}$ to the first node A, so the voltage of the first node A is $V_{data}$, i.e., the voltage of the first terminal of the capacitor C is $V_{data}$. The turned-on fourth switching transistor M4 electrically conducts the gate electrode of the driving transistor M0 and the source electrode of the driving transistor M0, so as to control the driving transistor M0 to be in the diode state. Because the driving transistor M0 which is in the state of diode connection and the turned-on fourth switching transistor M4 can enable the power supply terminal VSS to charge the capacitor C until the voltage of the gate electrode of the driving transistor M0 changes to $V_{ss}+V_{th}$h, i.e., the voltage of the second terminal of the capacitor C is $V_{ss}+V_{th}$. At present, the voltage difference between the two terminals of the capacitor C is: $V_{data}-V_{ss}-V_{th}$.

In the phase T4, the scanning signal Scan=0, the reset signal Re=0, and the light emission control signal EM1=1.

The fifth switching transistor M5 and the sixth switching transistor M6 are turned on due to EM1=1. The third switching transistor M3 and the fourth switching transistor M4 are turned off due to Scan=0. The first switching transistor M1 and the second switching transistor M2 are turned off due to Re=0. The turned-on fifth switching transistor M5 provides the reference signal $V_{ref}$ to the first node A, so the voltage of the first node A is $V_{ref}$. Because both the first switching transistor M1 and the fourth switching transistor M4 turn off, the gate electrode of the driving transistor M0 is in the floating state, i.e., the second terminal of the capacitor C is in the floating state. According to the law of charge conservation for the charge of the capacitor C before and after the jump, in order to maintain the voltage difference between the two terminals of the capacitor C to be still $V_{data}-V_{ss}-V_{th}$, the voltage of the second terminal of the capacitor C jumps to $V_{ref}-V_{data}+V_{ss}+V_{th}$, i.e., the voltage of the gate electrode of the driving transistor M0 is $V_{ref}\oplus V_{data}+V_{ss}+V_{th}$. At present, the driving transistor M0 is in the saturation state, and the voltage of the drain electrode of the driving transistor M0 is $V_{dd}$. According to the electric current characteristics of the saturation state, the operating electric current $I_L$ which flows through the driving transistor M0 and is used to drive the light emitting device L to emit light meets the following formula:

$$I_L=K(V_{gs}-V_{th})^2=K[(V_{ref}-V_{data}+V_{ss}+V_{th}-V_{ss})-V_{th}]^2=K(V_{ref}-V_{data})^2,$$

wherein $V_{gs}$ is the voltage between the gate electrode and the source electrode of the driving transistor M0; and K is a structure parameter and this value is relatively stable in the same structure and therefore can be regarded as a constant. It can be known from the above formula that the electric current of the driving transistor M0 when it is in the saturation state is only relevant to the voltage $V_{ref}$ of the reference signal $V_{ref}$ and the voltage $V_{data}$ of the data signal $V_{data}$, and is not relevant to the threshold voltage $V_{th}$ of the driving transistor M0 and the voltage $V_{ss}$ of the power supply terminal VSS. The problem that the threshold voltage $V_{th}$ drifts due to the formation process of the driving transistor M0 and the long-time operation can be solved, and the influence of the IR drop on the electric current flowing through the light emitting device can be avoided, so the operating electric current of the light emitting device L can be kept stable to achieve light emission stability.

In the above embodiment of the present disclosure, in one drive period, because one excitation pulse is applied to the gate electrode of the driving transistor in the phase T1, the voltage of the gate electrode of the driving transistor is easy to tend to the target voltage value, thereby rapidly eliminating the residual state in the previous light emitting phase, so the voltage of the gate electrode of the driving transistor can rapidly reach the voltage value of the preset voltage in the phase T2, thus the hysteresis phenomenon of the driving transistor can be alleviated and the response time thereof can be reduced.

At least one embodiment of the present disclosure provides a driving method of any one of the pixel circuits described above. The driving method comprises: providing the initial signal having the excitation pulse to the control electrode of the driving transistor, and providing the initial signal having the preset voltage to the control electrode of the driving transistor after the preset duration, there being a voltage difference between the voltage of the excitation pulse and the preset voltage.

Figure 9:
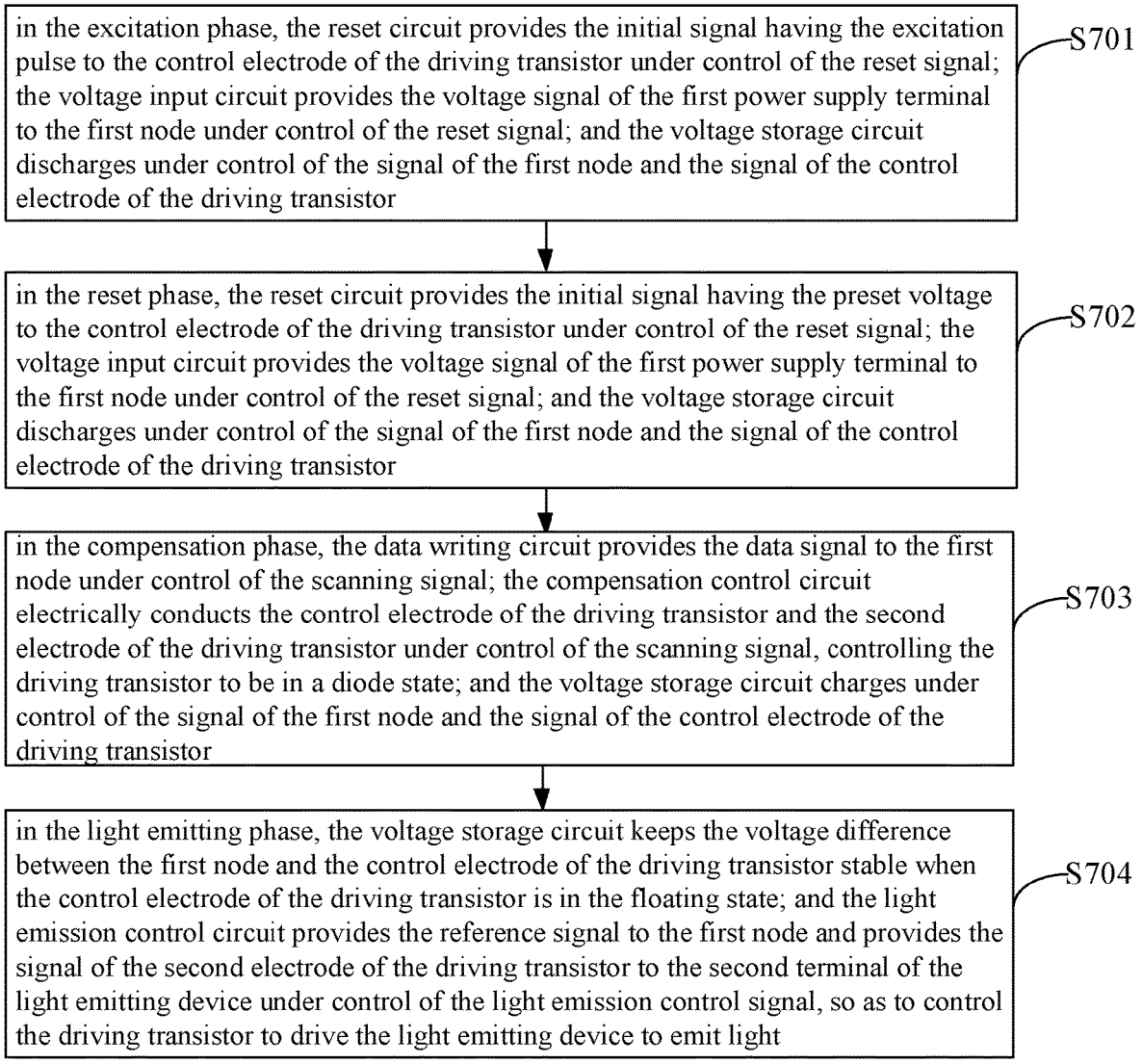
FIG. 9 is a flow chart of a driving method of a pixel circuit provided by an embodiment of the present disclosure.

At least one embodiment of the present disclosure also provides a driving method for any one of the pixel circuits provided by the embodiments of the present disclosure described above, as illustrated in FIG. 9, which comprises: an excitation phase, a reset phase, a compensation phase and a light emitting phase.

S701: in the excitation phase, the reset circuit provides the initial signal having the excitation pulse to the control electrode of the driving transistor under control of the reset signal; the voltage input circuit provides the voltage signal of the first power supply terminal to the first node under control of the reset signal; and the voltage storage circuit discharges under control of the signal of the first node and the signal of the control electrode of the driving transistor;

S702: in the reset phase, the reset circuit provides the initial signal having the preset voltage to the control electrode of the driving transistor under control of the reset signal; the voltage input circuit provides the voltage signal of the first power supply terminal to the first node under control of the reset signal; and the voltage storage circuit discharges under control of the signal of the first node and the signal of the control electrode of the driving transistor;

S703: in the compensation phase, the data writing circuit provides the data signal to the first node under control of the scanning signal; the compensation control circuit electrically conducts the control electrode of the driving transistor and the second electrode of the driving transistor under control of the scanning signal, controlling the driving transistor to be in a diode state; and the voltage storage circuit charges under control of the signal of the first node and the signal of the control electrode of the driving transistor; and

S704: in the light emitting phase, the voltage storage circuit keeps the voltage difference between the first node and the control electrode of the driving transistor stable when the control electrode of the driving transistor is in the floating state; and the light emission control circuit provides the reference signal to the first node and provides the signal of the second electrode of the driving transistor to the second terminal of the light emitting device under control of the light emission control signal, so as to control the driving transistor to drive the light emitting device to emit light.

In the above driving method provided by at least one embodiment of the present disclosure, the initial signal having the excitation pulse is provided to the control electrode of the driving transistor in the excitation phase to excite the voltage of the control electrode of the driving transistor, so the voltage of the control electrode of the driving transistor tends to the target voltage value to achieve compensation recovery; and the initial signal having the preset voltage is provided to the control electrode of the driving transistor in the reset phase, so that the voltage of the control electrode of the driving transistor rapidly reaches the preset voltage, thereby alleviating the problem of display afterimage due to the hysteresis phenomenon of the driving transistor.

An embodiment of the present disclosure also provides a display panel, which comprises any one of the pixel circuits provided by the embodiments of the present disclosure described above. The principle of the display panel to solve the problem is similar to the aforementioned pixel circuit, so the implementation of the display panel can refer to the implementation of the above pixel circuit, and the redundant description will not be repeated here.

In at least one implementation, in the above display panel provided by an embodiment of the present disclosure, the pixel circuits are arranged along the row direction, and the display panel may further comprise a display driver.

Figure 10:
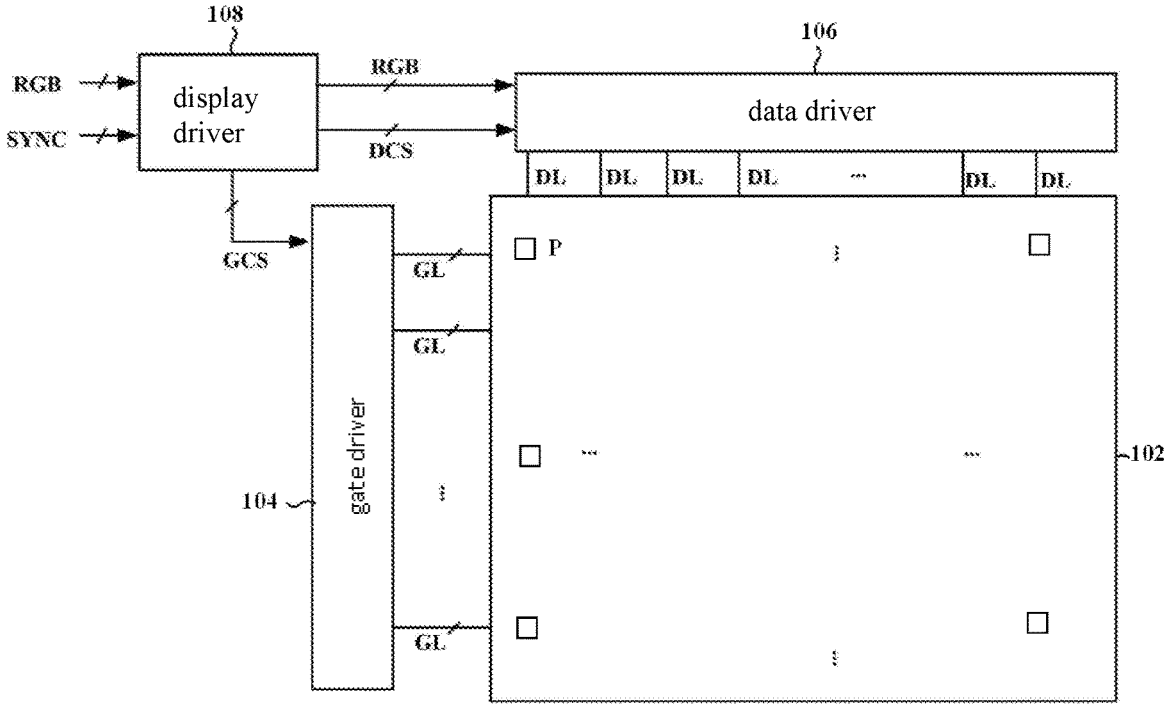
FIG. 10 is a block diagram of a display panel provided by an embodiment of the present disclosure.

An example of the display panel, for example, the organic light emitting diode (OLED) display panel provided by at least one embodiment of the present disclosure, is illustrated in FIG. 10.

As illustrated in FIG. 10, the OLED display panel comprises an array substrate 102. The array substrate 102 comprises a plurality of scanning lines (gate lines) GL and a plurality of data lines DL. The scanning lines and the data lines cross to define a plurality of sub-pixel units P. For example, the sub-pixel units P are arranged in a plurality of rows and a plurality of columns. The plurality of scanning lines (gate lines) correspond to the plurality of rows of sub-pixel units, and the plurality of data lines correspond to the plurality of columns of sub-pixel units. A gate driver 104 is configured to output the scanning signals Scan to the plurality of scanning lines GL. A data driver 106 is configured to output the data signals $V_{data}$ to the plurality of data lines DL. The OLED display panel further comprises a display driver 108, for example, the display driver is implemented as a timing controller, which is configured to set image data RGB input from outside the OLED display panel, provide the image data RGB to the data driver 106, and output a gate control signal GCS and a data control signal DCS to the gate driver 104 and the data driver 106 to control the gate driver 104 and the data driver 106, respectively. The array substrate further comprises a plurality of light emitting control lines (not illustrated), a power line (e.g., connected to the power supply terminal VDD or VSS), an initial signal line, and the like. The gate driver 104 is further configured to output the light emission control signal EM to these light emitting control lines. The display driver 108 is further configured to provide the high level voltage VDD, the reference voltage $V_{ref}$, the low level voltage VSS, the initial signal $V_{int}$, and the like.

The display driver 108, for example, may be implemented as an integrated circuit chip, for example, comprising a processing circuit and a storage circuit. The processing circuit is used for performing numerical and/or logical calculations, and the storage circuit is used for storing data for processing or data generated by the processing.

In addition, for adjacent two rows of sub-pixel units P, the control electrodes of the reset circuits of the sub-pixel units in the following row may be connected to the scanning line of the previous row, that is, the scanning line of the sub-pixel unit in the previous row is multiplexed as a reset line, so that the scanning signal Scan of the previous row can be multiplexed as the reset signal Re. In another example, the array substrate 102 may further comprise an independent reset line to provide the reset signal Re.

In at least one embodiment, the display driver is configured to determine the preset voltage of the initial signal according to the type of the driving transistor in the pixel circuit, and determine the excitation pulse of the initial signal according to the determined preset voltage and the duration of scanning one row of pixel circuits in the display panel. When the pixel circuit is in the excitation phase, the display driver inputs the excitation pulse to an initial signal terminal. When the pixel circuit is in the reset phase, the display driver inputs the preset voltage to the initial signal terminal. In this way, the corresponding excitation pulse and the corresponding preset voltage can be input to the pixel circuit according to the specific structure of the display panel.

In at least one embodiment, in the above display panel provided by an embodiment of the present disclosure, when the driving transistor of the pixel circuit is determined as a P-type transistor, the excitation pulse of the initial signal is the excitation pulse having a negative voltage. That is, the effective voltage of the excitation pulse is less than the preset voltage. For example, the initial voltage Vint is 0V, and the effective voltage of the excitation pulse SP may be −8V. Of course, the effective voltage of the excitation pulse SP may also be set as other voltages that meet the above conditions, which is not limited herein. Alternatively, in order to better alleviate the hysteresis phenomenon of the driving transistor, the excitation pulse comprises the excitation sub-pulse having a negative voltage and the excitation sub-pulse having a positive voltage. When the driving transistor is determined as a P-type transistor, the excitation pulse first is the excitation sub-pulse having the negative voltage, and then is the excitation sub-pulse having the positive voltage. For example, the initial voltage Vint is 0V, the effective voltage of the excitation sub-pulse having the negative voltage may be −8V, and the effective voltage of the excitation sub-pulse having the positive voltage may be 8V. Of course, the effective voltage of the excitation sub-pulse having the negative voltage may also be −5V, and the effective voltage of the excitation sub-pulse having the positive voltage may also be 8V. Of course, the effective voltage of the excitation sub-pulse having the positive voltage and the effective voltage of the excitation sub-pulse having the negative voltage may also be set as other voltages that meet the above conditions, which is not limited in this embodiment.

Alternatively, in at least one example, in the above pixel circuit provided by an embodiment of the present disclosure, when the driving transistor M0 is determined as an N-type transistor, the excitation pulse of the initial signal is the excitation pulse having a positive voltage. That is, the effective voltage of the excitation pulse is greater than the preset voltage. For example, the initial voltage Vint is 3V, and the effective voltage of the excitation pulse may be 8V. Of course, the effective voltage of the excitation pulse may also be set as other voltages that meet the above conditions, which is not limited herein. Alternatively, in order to better alleviate the hysteresis phenomenon of the driving transistor, the excitation pulse comprises the excitation sub-pulse having the negative voltage and the excitation sub-pulse having the positive voltage. When the driving transistor is determined as an N-type transistor, the excitation pulse first is the excitation sub-pulse having the positive voltage, and then is the excitation sub-pulse having the negative voltage. For example, the initial voltage Vint is 3V, the effective voltage of the excitation sub-pulse having the negative voltage may be −8V, and the effective voltage of the excitation sub-pulse having the positive voltage may be 8V. Of course, the effective voltage of the excitation sub-pulse having the negative voltage may also be −5V, and the effective voltage of the excitation sub-pulse having the positive voltage may also be 8V. Of course, the effective voltage of the excitation sub-pulse having the positive voltage and the effective voltage of the excitation sub-pulse having the negative voltage may also be set as other voltages that meet the above conditions, which is not limited in this embodiment.

In at least one example, in the above display panel provided by an embodiment of the present disclosure, the display driver inputs the initial signal to each of the pixel circuits through a same signal line.

For example, the display driver is further configured to determine one period duration of the initial signal according to the duration of scanning one row of pixel circuits in the display panel in the row-by-row process. Of course, the display driver may also input the initial signal to each pixel circuit through a signal line which is in one-to-one correspondence with each pixel circuit.

For example, the refresh rate of the display panel comprises: 50 HZ, 60 HZ, 120 Hz, or the like. The screen resolutions of different types of display panels are also different. The screen resolutions are, for example, high definition (HD), full high definition (FHD), and quarter high definition (QHD). Therefore, the durations of scanning one row of pixel circuits in different types of display panels are also different. When the type of the display panel is HD, taking the initial signal illustrated in FIG. 5A as an example, the preset duration may be set as 2 μs, in which the duration of the excitation sub-pulse having the negative voltage is 1 μs, the duration of the excitation sub-pulse having the positive voltage is 1 μs, and the duration of each period may be 16.7 μs. In the actual application, the duration of scanning one row of pixel circuits in the display panel needs to be determined according to the actual application environment, which is not limited herein.

In at least one example, in the above display panel provided by an embodiment of the present disclosure, the display panel may be an organic electroluminescent display panel.

Figure 11:
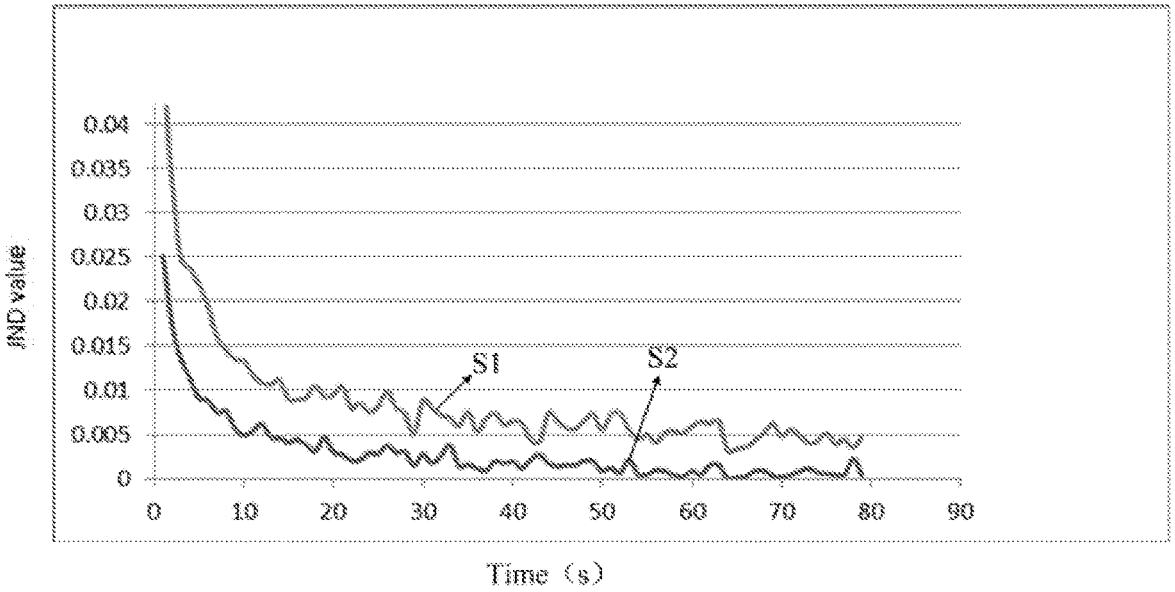
FIG. 11 is a schematic diagram of detected JND values of a display panel provided by an embodiment of the present disclosure.

Generally the display effect of a display panel is measured through a just noticeable difference (JND) value, and when the JND value is less than or equal to 0.004, the human eye hardly perceives the problem of afterimage when the display panel displays two adjacent frames. Taking the case that the display panel comprises the pixel circuit illustrated in FIG. 6A as an example, the display panel is detected to obtain the JND values before and after the adjustment. In FIG. 11, the abscissa represents time, the ordinate represents the JND value, S1 represents a JND curve obtained by detecting a display panel in which a constant DC voltage serves as the initial signal in the prior art, and S2 represents a JND curve of a display panel provided by an embodiment of the present disclosure. It can be seen from FIG. 11 that the JND value of curve S2 can reach 0.005 at 10 s, while the JND value of curve S1 can occasionally reach 0.005 at nearly 30 s. The curve S2 decreases faster than the curve S1, so the curve S2 can reach 0.004 faster than the curve S1. This illustrates that in the embodiment of the present disclosure, when the pixel circuit in the display panel is in the excitation phase, the excitation pulse is input to the initial signal terminal, thus the control electrode of the driving transistor can be input with the excitation pulse to excite the control electrode of the driving transistor, so the voltage of the control electrode of the driving transistor tends to the target voltage value to achieve compensation recovery; and when the pixel circuit is in the reset phase, the preset voltage is input to the initial signal terminal, so the voltage of the control electrode of the driving transistor in the pixel circuit is the preset voltage. Compared with display panels in the prior art, the problem of display afterimage of the display panel due to the hysteresis phenomenon of the driving transistor can be alleviated.

Figure 12:
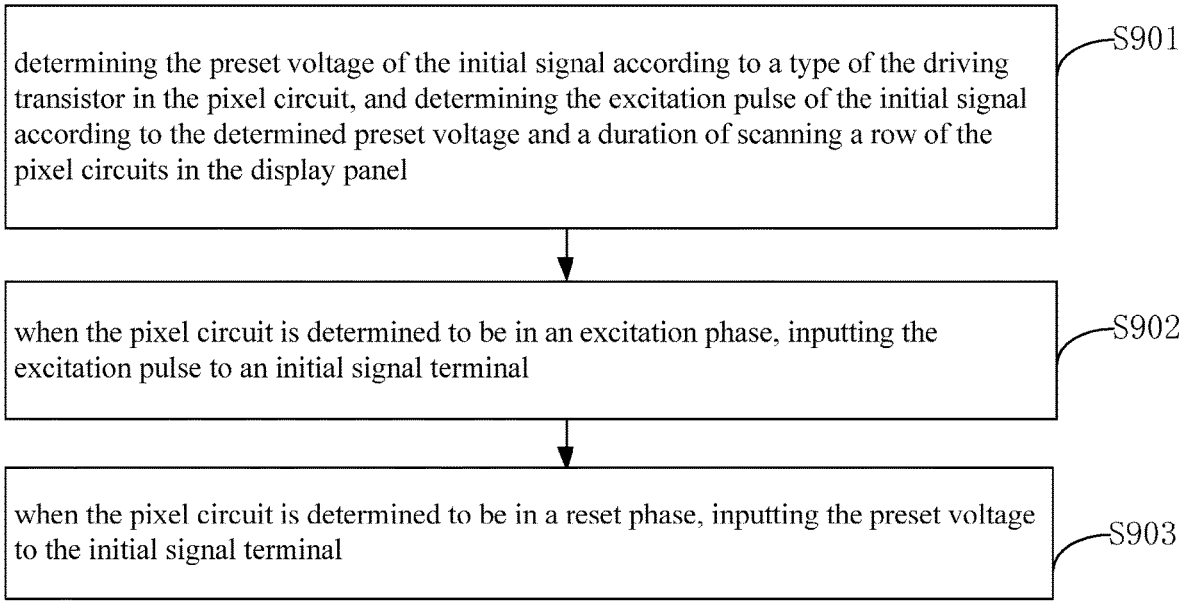
FIG. 12 is a flow chart of a driving method of a display panel provided by an embodiment of the present disclosure.

At least one embodiment of the present disclosure also provides a driving method of any one of the above display panels provided by the embodiments of the present disclosure, as illustrated in FIG. 12, which comprises the following operations:

S901: determining the preset voltage of the initial signal according to the type of the driving transistor in the pixel circuit, and determining the excitation pulse of the initial signal according to the determined preset voltage and the duration of scanning a row of the pixel circuits in the display panel;

S902: when the pixel circuit is determined to be in the excitation phase, inputting the excitation pulse to the initial signal terminal; and S903: when the pixel circuit is determined to be in the reset phase, inputting the preset voltage to the initial signal terminal.

In the above driving method provided by an embodiment of the present disclosure, the preset voltage of the initial signal may be determined according to the type of the driving transistor in the pixel circuit, and the excitation pulse of the initial signal may be determined according to the determined preset voltage and the duration of scanning a row of the pixel circuits in the display panel. When the pixel circuit is in the excitation phase, the excitation pulse is input to the initial signal terminal, thus the control electrode of the driving transistor can be input with the excitation pulse to excite the control electrode of the driving transistor, so the voltage of the control electrode of the driving transistor tends to the target voltage value to achieve compensation recovery; and when the pixel circuit is in the reset phase, the preset voltage is input to the initial signal terminal, so the voltage of the control electrode of the driving transistor in the pixel circuit is the preset voltage, thereby alleviating the problem of display afterimage of the display panel due to the hysteresis phenomenon of the driving transistor.

An embodiment of the present disclosure also provides a display device, which comprises the above display panel provided by an embodiment of the present disclosure. The display device may be any product or component having a display function such as a mobile phone, a tablet computer, a television set, a displayer, a notebook computer, a digital photo frame, a navigator, and the like. The other essential components of the display device are understood by those skilled in the art, which are not repeated here, and should not be construed as a limitation of the present disclosure. The implementation of the display device may refer to the above embodiments of the pixel circuit, and the repeated description will not be repeated here.

What are described above is related to the illustrative embodiments of the disclosure only and not limitative to the scope of the disclosure; the scopes of the disclosure are defined by the accompanying claims.

The application claims priority to the Chinese patent application No. 201710071641.X, filed on Feb. 9, 2017, the entire disclosure of which is incorporated herein by reference as part of the present application.

What is claimed is:

1. A pixel circuit, comprising: a reset circuit, a data writing circuit, a driving transistor and a light emitting device, wherein the driving transistor comprises a control electrode, a first electrode and a second electrode, the light emitting device comprises a first terminal and a second terminal, the first electrode of the driving transistor is configured to be connected to a first power supply terminal, the second electrode of the driving transistor is configured to be connected to the second terminal of the light emitting device, and the first terminal of the light emitting device is configured to be connected to a second power supply terminal;

the reset circuit is connected to the control electrode of the driving transistor, and is configured to provide an initial signal having an excitation pulse to the control electrode of the driving transistor under control of a reset signal, and provide the initial signal having a preset voltage to the control electrode of the driving transistor after a preset duration, and there is a voltage difference between a voltage of the excitation pulse and the preset voltage; and the data writing circuit is configured to provide a data signal to the driving transistor under control of a scanning signal;

in a period during which the initial signal having the excitation pulse is provided and in a period during which the initial signal having the preset voltage is provided, the reset signal remains unchanged, and the scanning signal remains unchanged.

2. A display panel, comprising a plurality of sub-pixel units, each of the sub-pixel units comprising the pixel circuit according to claim 1.

3. The display panel according to claim 2, further comprising a display driver, wherein the display driver is configured to provide the initial signal having the excitation pulse to the control electrode of the driving transistor, and provide the initial signal having the preset voltage to the control electrode of the driving transistor after the preset duration.

4. The display panel according to claim 3, wherein the display driver inputs the initial signal to the pixel circuits of the sub-pixel units in a same row through a same signal line; and the display driver is further configured to determine a period duration of the initial signal according to a duration of scanning one row of sub-pixel units in the display panel.

5. The display panel according to claim 2, further comprising a display driver, wherein the display driver is configured to determine the preset voltage of the initial signal according to a type of the driving transistor in the pixel circuit, and determine the excitation pulse of the initial signal according to the determined preset voltage and a duration of scanning one row of sub-pixel units in the display panel;

when the pixel circuit is in an excitation phase, the excitation pulse is input to the reset circuit; and when the pixel circuit is in a reset phase, the preset voltage is input to the reset circuit.

6. A display device, comprising the display panel according to claim 2.

7. A driving method of the display panel according to claim 2, comprising:

determining the preset voltage of the initial signal according to a type of the driving transistor in the pixel circuit, and determining the excitation pulse of the initial signal according to the determined preset voltage and a duration of scanning one row of the pixel circuits in the display panel;

when the pixel circuit is determined to be in an excitation phase, inputting the excitation pulse to the reset circuit; and when the pixel circuit is determined to be in a reset phase, inputting the preset voltage to the reset circuit.

8. The pixel circuit according to claim 1, further comprising: a voltage input circuit, a compensation control circuit, a voltage storage circuit, a light emission control circuit and a first node;

wherein the voltage input circuit is connected to the first node and the first power supply terminal, and is configured to provide a voltage signal of the first power supply terminal to the first node under control of the reset signal;

the data writing circuit is connected to the first node, and is configured to provide the data signal to the first node under control of the scanning signal;

the compensation control circuit is connected to the control electrode of the driving transistor and the second electrode of the driving transistor, and is configured to electrically conduct the control electrode of the driving transistor and the second electrode of the driving transistor under control of the scanning signal;

the voltage storage circuit is connected to the control electrode of the driving transistor and the first node, and is configured to charge or discharge under control of a signal of the first node and a signal of the control electrode of the driving transistor, and keep a voltage difference between the first node and the control electrode of the driving transistor stable when the control electrode of the driving transistor is in a floating state; and the light emission control circuit is configured, under control of a light emission control signal, to provide a reference signal to the first node and provide a signal of the second electrode of the driving transistor to the second terminal of the light emitting device.

9. The pixel circuit according to claim 8, wherein the reset circuit comprises: a first switching transistor, wherein a control electrode of the first switching transistor is configured to receive the reset signal, a first electrode of the first switching transistor is configured to receive the initial signal, and a second electrode of the first switching transistor is connected to the control electrode of the driving transistor.

10. The pixel circuit according to claim 8, wherein the voltage input circuit comprises a second switching transistor, wherein a control electrode of the second switching transistor is configured to receive the reset signal, a first electrode of the second switching transistor is connected to the first power supply terminal, and a second electrode of the second switching transistor is connected to the first node.

11. The pixel circuit according to claim 8, wherein the compensation control circuit comprises a fourth switching transistor, wherein a control electrode of the fourth switching transistor is configured to receive the scanning signal, a first electrode of the fourth switching transistor is connected to the control electrode of the driving transistor, and a second electrode of the fourth switching transistor is connected to the second electrode of the driving transistor.

12. The pixel circuit according to claim 8, wherein the light emission control circuit comprises a fifth switching transistor and a sixth switching transistor, wherein a control electrode of the fifth switching transistor is configured to receive the light emission control signal, a first electrode of the fifth switching transistor is configured to receive the reference signal, and a second electrode of the fifth switching transistor is connected to the first node; and a control electrode of the sixth switching transistor is configured to receive the light emission control signal, a first electrode of the sixth switching transistor is connected to the second electrode of the driving transistor, and a second electrode of the sixth switching transistor is connected to the second terminal of the light emitting device.

13. The pixel circuit according to claim 8, wherein the voltage storage circuit comprises at least one capacitor, wherein a first terminal of the capacitor is connected to the first node, and a second terminal of the capacitor is connected to the control electrode of the driving transistor.

14. A driving method of the pixel circuit according to claim 8, comprising: an excitation phase, a reset phase, a compensation phase and a light emitting phase;

wherein in the excitation phase, the reset circuit provides the initial signal having the excitation pulse to the control electrode of the driving transistor under control of the reset signal; the voltage input circuit provides the voltage signal of the first power supply terminal to the first node under control of the reset signal; and the voltage storage circuit discharges under control of the signal of the first node and the signal of the control electrode of the driving transistor;

in the reset phase, the reset circuit provides the initial signal having the preset voltage to the control electrode of the driving transistor under control of the reset signal; the voltage input circuit provides the voltage signal of the first power supply terminal to the first node under control of the reset signal; and the voltage storage circuit discharges under control of the signal of the first node and the signal of the control electrode of the driving transistor;

in the compensation phase, the data writing circuit provides the data signal to the first node under control of the scanning signal; the compensation control circuit electrically conducts the control electrode of the driving transistor and the second electrode of the driving transistor under control of the scanning signal, controlling the driving transistor to be in a diode state; and the voltage storage circuit charges under control of the signal of the first node and the signal of the control electrode of the driving transistor; and in the light emitting phase, the voltage storage circuit keeps the voltage difference between the first node and the control electrode of the driving transistor stable when the control electrode of the driving transistor is in the floating state; and the light emission control circuit provides the reference signal to the first node and provides the signal of the second electrode of the driving transistor to the second terminal of the light emitting device under control of the light emission control signal, so as to control the driving transistor to drive the light emitting device to emit light.

15. The pixel circuit according to claim 1, wherein the driving transistor is a P-type transistor, and the excitation pulse is an excitation pulse having a negative voltage; or the driving transistor is an N-type transistor, and the excitation pulse is an excitation pulse having a positive voltage.

16. The pixel circuit according to claim 1, wherein the excitation pulse comprises an excitation sub-pulse having a negative voltage and an excitation sub-pulse having a positive voltage;

the driving transistor is a P-type transistor, and the excitation pulse first is the excitation sub-pulse having the negative voltage, and then is the excitation sub-pulse having the positive voltage; or the driving transistor is an N-type transistor, and the excitation pulse first is the excitation sub-pulse having the positive voltage, and then is the excitation sub-pulse having the negative voltage.

17. The pixel circuit according to claim 1, wherein the data writing circuit comprises a third switching transistor, wherein a control electrode of the third switching transistor is configured to receive the scanning signal, and a first electrode of the third switching transistor is configured to receive the data signal.

18. A driving method of the pixel circuit according to claim 1, comprising:

providing the initial signal having the excitation pulse to the control electrode of the driving transistor, and providing the initial signal having the preset voltage to the control electrode of the driving transistor after the preset duration.

* * * * *